US007438407B2

(12) United States Patent
Coghlan et al.

(10) Patent No.: US 7,438,407 B2
(45) Date of Patent: Oct. 21, 2008

(54) METHOD AND APPARATUS FOR CREATING AN IMAGE ON AN ARTICLE, AND ARTICLE RESULTING THEREFROM

(75) Inventors: Henry M. Coghlan, Elburn, IL (US); Karine A. Luetgert, Geneva, IL (US); Jimmy R. Parchment, St. Charles, IL (US); Stephen G. Huhn, Cincinnati, OH (US)

(73) Assignee: Masonite Corporation, Tampa, FL (US)

( * ) Notice: Subject to any disclaimer, the term of this patent is extended or adjusted under 35 U.S.C. 154(b) by 36 days.

(21) Appl. No.: 11/226,470

(22) Filed: Sep. 15, 2005

(65) Prior Publication Data

US 2006/0059821 A1 Mar. 23, 2006

Related U.S. Application Data

(60) Provisional application No. 60/609,868, filed on Sep. 15, 2004.

(51) Int. Cl.
*B41J 2/01* (2006.01)

(52) U.S. Cl. ..... 347/105; 347/101; 347/102; 347/107

(58) Field of Classification Search ..... 347/100, 347/95, 96, 101, 102, 105, 107; 523/160; 106/31.6, 31.27, 31.13; 428/195, 32.1
See application file for complete search history.

(56) References Cited

U.S. PATENT DOCUMENTS

| | | | | |
|---|---|---|---|---|
| 5,741,578 | A | 4/1998 | Sax | |
| 6,267,476 | B1 * | 7/2001 | Kato et al. | 347/100 |
| 7,001,016 | B2 * | 2/2006 | Baxter et al. | 347/101 |

FOREIGN PATENT DOCUMENTS

| | | |
|---|---|---|
| WO | WO 95/31343 | * 11/1995 |
| WO | WO 03/084760 | 10/2003 |
| WO | WO 2004/067292 | 8/2004 |

* cited by examiner

*Primary Examiner*—Manish S Shah
(74) *Attorney, Agent, or Firm*—Berenato, White & Stavish

(57) ABSTRACT

The present invention is directed to a method of printing an image on an object, such as a door facing or a door. An object having an exterior surface is provided. A first image component is printed on the exterior surface. A first transparent coat is applied on the exterior surface so as to cover the first image component. A second image component is printed on the first transparent coat. Optionally, a second transparent coat is applied to the first transparent coat and second image component so as to cover the first and second image components. The resulting object, such as a door, having the printed image thereon is also disclosed.

22 Claims, 18 Drawing Sheets

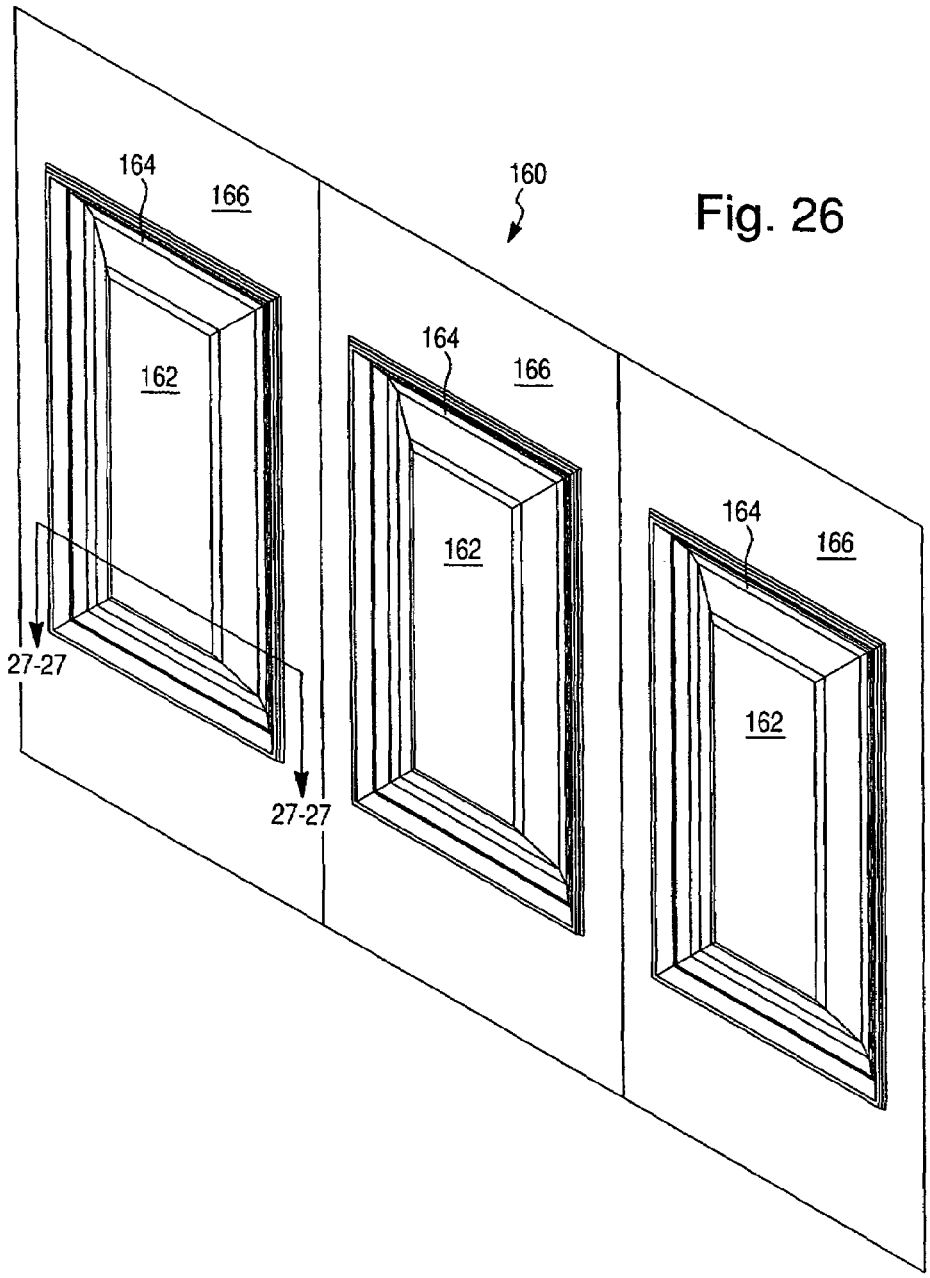
Fig. 26
Fig. 27
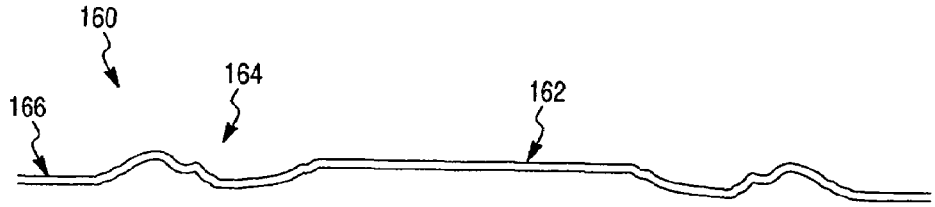

METHOD AND APPARATUS FOR CREATING AN IMAGE ON AN ARTICLE, AND ARTICLE RESULTING THEREFROM

CROSS-REFERENCE TO RELATED APPLICATION AND CLAIM TO PRIORITY

This application is based on provisional application Ser. No. 60/609,868, filed Sep. 15, 2004, for Henry M. Coghlian et al, the disclosure of which is incorporated herein by reference and to which priority is claimed under 35 U.S.C. §120.

FIELD OF THE INVENTION

The present invention is directed to a method of printing an image on an object, especially a door component object, such as a door skin. The invention also relates to the object and an assembly comprising the object with the printed image, and a printing apparatus for carrying out the method and creating the printed object and assembly.

BACKGROUND OF THE INVENTION

Solid wood provides aesthetic qualities that are desirable to many consumers and therefore preferred for various products. However, solid, natural wood is a relatively expensive material, and thus items made from natural wood are generally more expensive than items made from alternative materials such as plastic or wood composite. As the price of natural wood has increased, the market for manufactured products that simulate natural wood has grown.

The door market is a good example of a market in which natural wood has been replaced with simulated wood materials. The natural wood facade of doors has been largely replaced by steel, which currently dominates the exterior entry door market. Generally, a steel door comprises a rectangular peripheral frame, and door skins (also referred to as door facings) respectively attached to the opposite sides of the peripheral frame. The interior of the door, i.e., between the skins, may remain hollow, or may be filled with, for example, corrugated pads, a contoured wood fiber core, insulation or other material if desired. The exterior surfaces of the steel door skins may possess a smooth, planar surface, known as a flush door skin, or a contoured surface simulating, for example, stiles, rails, panels, and other features found in traditional wooden rail and stile doors. Steel facings typically provide excellent corrosion resistance and heavy-duty protection, and are available with design options that complement a variety of architectural styles. Steel doors are often specified for the passage door between the home and the attached garage for fire protection.

One of the drawbacks to steel doors is the difficulty in forming a crisp, realistic multi-directional wood grain appearance and texture on the exterior surface of the door facings. Generally, wood grain patterns embossed on steel doors appear flat and lack three-dimensionality. Also, the surfaces are smooth and devoid of delicate texture that is expected of wood. These drawbacks have contributed to a recent decline in the market share held by steel doors.

Wood composite and fiberglass door skins hold a significant and expanding share of the exterior door market. However, wood composite and fiberglass doors also lack the appearance of natural wood, especially the color, grain and/or inlay patterns that are considered desirable by many consumers.

It is therefore desirable to provide a method of printing either wood grain images or other graphic images on the surface of a flush, textured, or contoured article, such as a door skin or door, in a manner that produces high quality images, an impression of depth, and optionally texture over the exterior surface being printed.

SUMMARY OF THE INVENTION

The present invention is related to a method of printing an image on an object, such as a wood grain pattern on a door skin, the resulting printed object, methods of making articles and assemblies comprising the object, and the resulting articles and assemblies. The invention is also related to an image processing apparatus for creating an image to be printed. The method and apparatus may be utilized to create various decorative products, such as passageway door systems, including exterior door sidelights and doors for residential and commercial use, millwork, molding, plant-on panels, closet or wardrobe doors, molded wainscot, decorative cabinet doors, and exterior polymeric doors. The method may also be used to enhance natural wood and veneer faced surfaces.

The images preferably are printed on the article using an ink jet printer, which provides great flexibility in what can be printed. Aspects of the present invention allow a wide variety of products to be printed easily using the disclosed printing technique. Customized objects, such as simulated wood species and decorative graphic images, can be produced quickly and cheaply. Printing a wood grain pattern onto an article using a printer according to embodiments of the invention has been found to give a good result easily and relatively cheaply compared with the use of a wood or wood veneer faced doors. As used herein, the term "wood grain" includes any pattern resembling a feature of wood grain or stained wood, preferably of any type of wood.

The disclosed method may be used to print on a part or all of a surface of an object. For example, a simulated wood region may form only a part of an object, for example a frame of a framed picture. Ink jet printing provides the flexibility to print in register on small areas of an object.

According to a first aspect of the invention, a method of printing on an object is provided. The method comprises providing an object having an exterior surface, printing a first image component on the exterior surface, applying a first transparent coat on the exterior surface so as to cover the first image component, printing a second image component on first transparent coat, and optionally yet preferably applying a second transparent coat over the first transparent coat so as to cover the first and second image components.

A second aspect of the invention provides an object having an exterior surface, a first printed image component on the exterior surface, a first transparent coat on the exterior surface and covering the first image component, a second image component printed on the first transparent coat, and optionally yet preferably a second transparent coat on the first transparent coat and covering the first and second image components.

In accordance with a third aspect of the invention, a method is provided for making a door having a printed image on an exterior surface thereof. The method comprises providing a rectangular frame and a door skin, printing a first image component on the exterior surface of the door skin, applying a first transparent coat on the exterior surface so as to cover the first image component, printing a second image component on first transparent coat, optionally yet preferably applying a second transparent coat over the first transparent coat so as to cover the first and second image components, and attaching the first door skin to the rectangular frame.

A fourth aspect of the invention provides a door having a printed image. The door comprises a door skin attached to a rectangular frame. The door skin has an exterior surface comprising a first printed image component, a first transparent coat on the exterior surface and covering the first printed image component, a second image component printed on the first transparent coat, and optionally yet preferably a second transparent coat over the first transparent coat and covering the first and second image components.

It is preferred yet optional in the above-described aspects for the first image component and the second image component to be substantially registered with one another to provide the overall appearance of an overall image (comprising the first and second image components) with an impression of depth and optionally texture.

In another preferred yet optional embodiment of the above-described aspects of the invention, the article may comprise a printing sheet applied to the object in such a manner that the printing sheet constitutes the exterior surface on which the first image component is printed.

It is also preferred yet optional for the first and second image components to comprise a vessel wood grain image and a tick wood grain image, respectively, to collectively form an overall wood grain pattern image.

BRIEF DESCRIPTION OF THE FIGURES

The accompanying drawings are incorporated in and constitute a part of the specification. The drawings, together with the general description given above and the detailed description of the preferred embodiments and methods given below, serve to explain the principles of the invention. In such drawings:

FIG. 26 is a perspective view of wainscot suitable for being printed according to an embodied printing method;

FIG. 27 is a fragmentary cross-sectional view taken along line 27-27 of FIG. 26 and viewed in the direction of the arrows;

DETAILED DESCRIPTION OF PREFERRED EMBODIMENTS AND METHODS OF THE INVENTION

Figure 1:
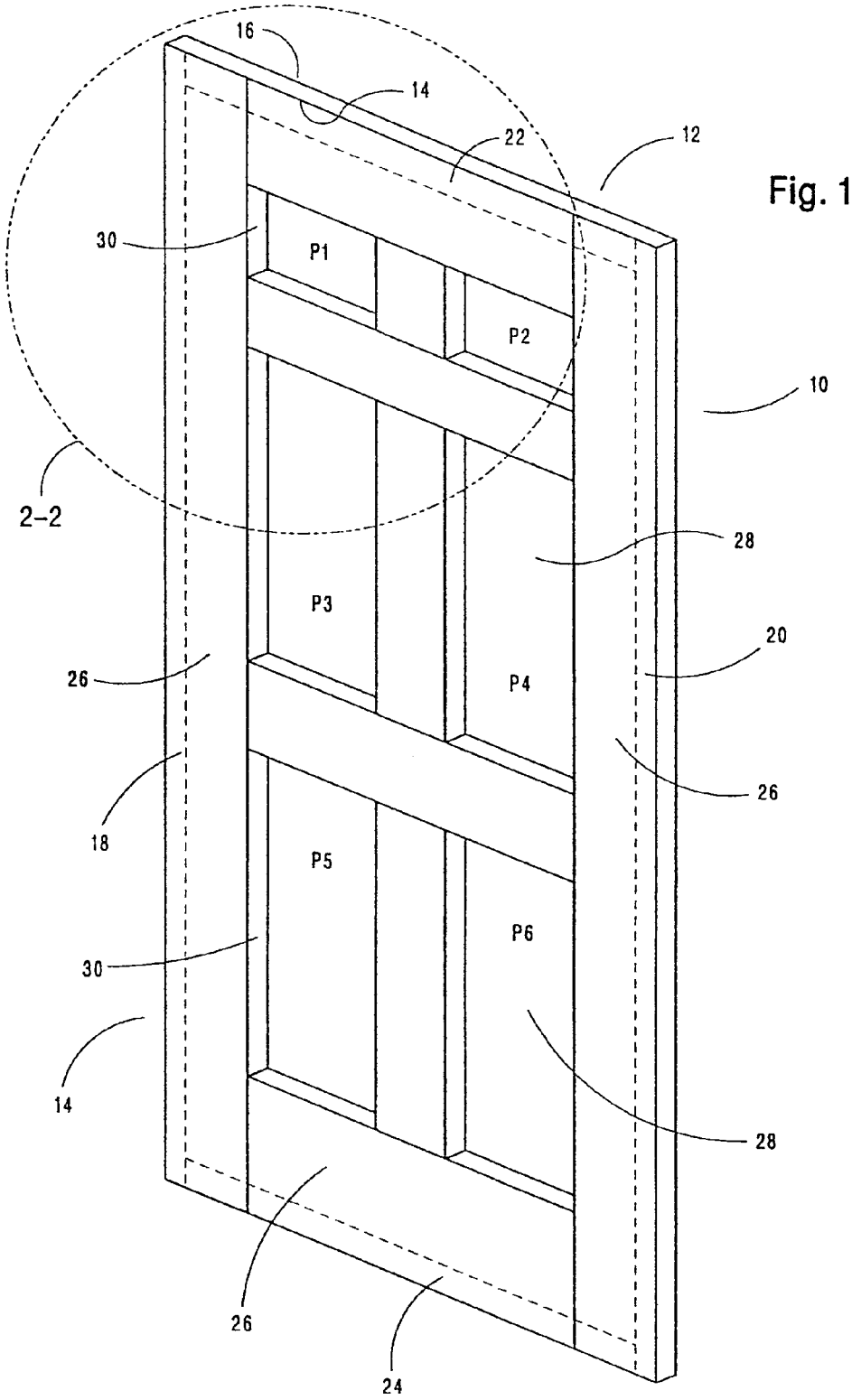
FIG. 1 is a perspective view of a door to be printed according to an embodiment of the present invention.

Reference will now be made in detail to the presently preferred embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in this section in connection with the preferred embodiments and methods. The invention according to its various aspects is particularly pointed out and distinctly claimed in the attached claims read in view of this specification, and appropriate equivalents.

It is to be noted that, as used in the specification and the appended claims, the singular forms "a," "an," and "the" include plural referents unless the context clearly dictates otherwise.

The present invention is directed to a method and apparatus for creating an image on an article, such as a simulated wood grain pattern on a door skin, preferably using an ink jet printer. Any object (or article) that can be printed on using ink jet printing is suitable for the disclosed invention. Preferably, the printed object includes hard rigid surfaces, although other surfaces, such as wood veneer or paper overlaid wood composites, are also suitable.

The printed object preferably comprises a three-dimensional object. Examples of suitable objects to be printed upon include exterior passage and interior passage doors and door systems, furniture and cabinet doors, closet and bifold doors, door frames and moldings, widow frames, furniture components, tables, picture frames, molded wall paneling, fixtures, fittings, constructions, wainscot and other such objects.

A door and/or a door skin are particularly preferred for application of the disclosed printing method. The door skins or other objects may be made of any material suitable for their intended use, including steel, wood composites, fiberglass composites, etc. For purposes of explanation, the present invention will be explained with referenced to a door 10 that is to be printed, as best shown in FIG. 1. However, it should be understood that other objects are suitable for printing, as noted above.

Door 10 comprises a peripheral frame 12, and first and second door skins 14, 16 secured to opposing sides of frame 12. (Note that only an edge of skin 16 is shown in FIG. 1). Frame 12 includes opposing stiles 18, 20 and rails 22, 24. Door 10 is preferably a solid core door, as known in the art. Skins 14, 16 are preferably made of or comprise a metal or metal alloy, more preferably steel. Alternatively, skins 14, 16 may be molded from a composite wood material, such as medium density fiberboard (MDF) or high density hardboard, but other substrates such as fiberglass door faces, polymeric door faces, natural wood or plywood, post-molded wood composites, and doors with special film or paper overlay surfaces may be used. Furthermore, skins 14, 16 may be formed using any known method, such as molding, embossing, wet-dry press molding, dry press molding, or post-forming. Each of skins 14, 16 includes an exterior surface and an interior surface for securing to frame 12 using adhesive or other means (e.g., fasteners) to form door 10. As known in the art, door 10 may also include additional support members and/or door core materials disposed between skins 14, 16. The door skins 14, 16 may possess respective designs that are the same or different from one another.

Figure 2:
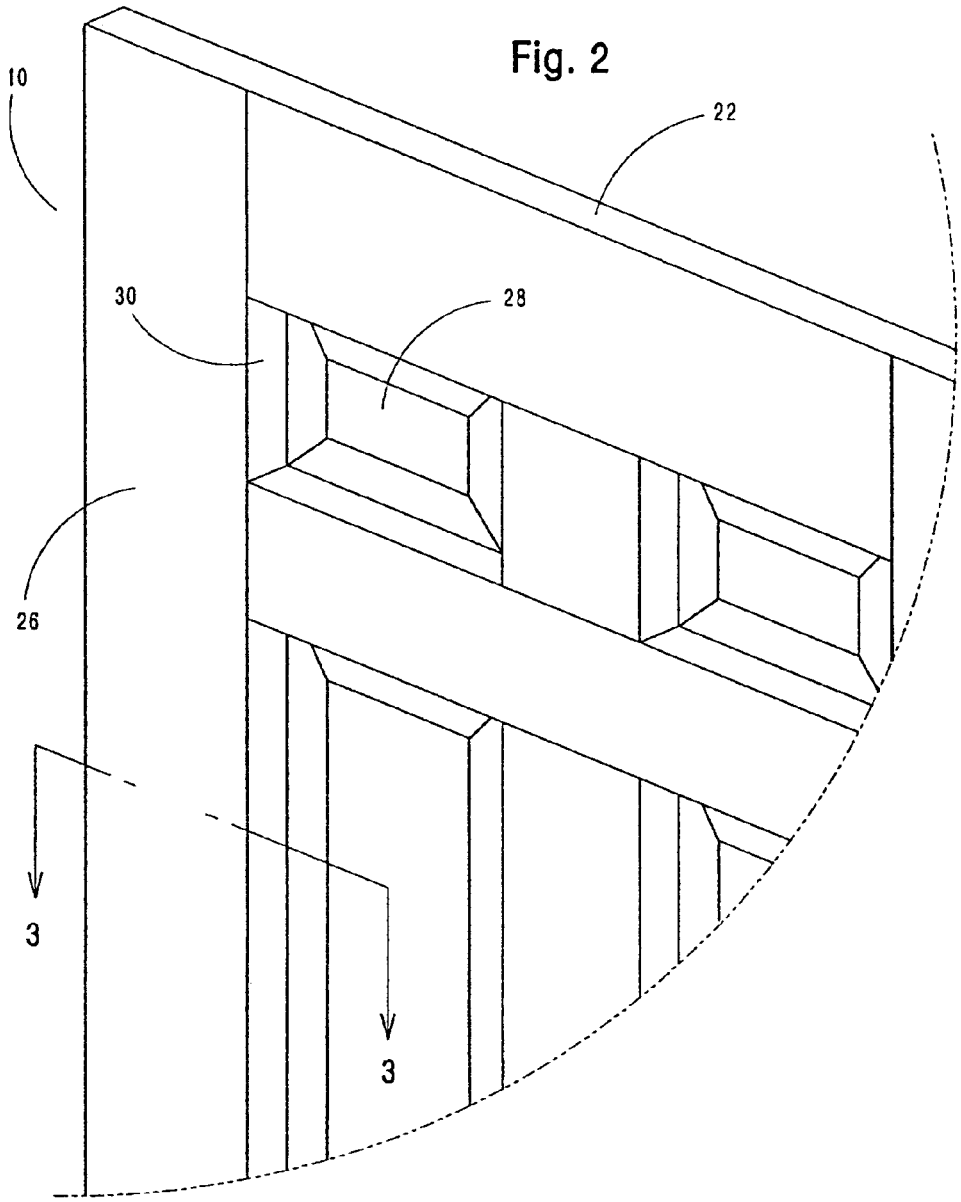
FIG. 2 is a fragmentary enlarged view of circled area 2-2 of FIG. 1.
Figure 3:
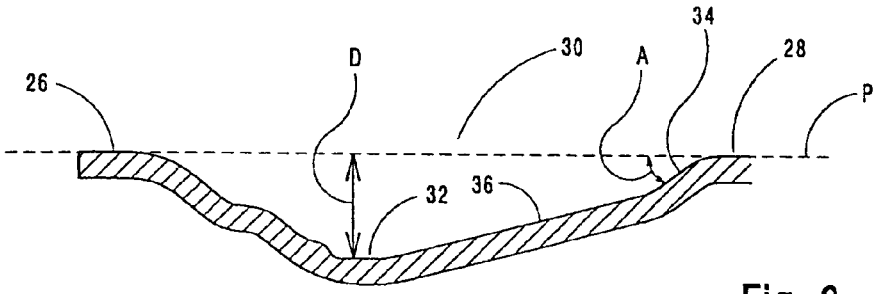
FIG. 3 is a cross-sectional fragmentary view of the door of FIG. 2 viewed at line 3-3 in the direction of the arrows.

Door skins 14, 16 of FIGS. 1 through 5 include major planar portions 26 and simulated panels 28 surrounded by channels 30. Channels 30 are recessed from the plane P of planar portions 26, as best shown in FIGS. 2 and 3. As best shown in FIG. 3, each channel 30 has a depth D, defined as the separation between the plane P of planar portion 26 and a bottom 32 of channel 30. Depth D is preferably between about 1 mm and about 11 mm. Channels in steel door skins usually have a depth D at the lower end or below this range. Each channel 30 may also include sloped sidewalls 34 extending downwardly at an angle A towards bottom 32 relative to the plane of panel portions 28 (which is preferably coplanar with plane P, as shown in FIG. 3). Preferably, sloped sidewalls 34 extend downwardly at an angle A of 80 degrees or less relative to plane P of planar portion 28. Sloped sidewalls 34 preferably include a flat portion 36; however, portions of sloped sidewalls 34 may also be contoured. Channels 30 define simulated panels 28, as in a natural, solid wood door. For example, door 10 includes channels 30 simulating panels P1, P2, P3, P4, P5 and P6. It is to be understood, however, that the illustrated channels 30 are optional, and one or both of door skins 14, 16 may comprise a flat, planar sheet without channels or panels.

Prior to subjecting the object to printing, the object may be prepared for printing or pre-treated. For example, the object may be cleaned, for example with a cloth or wipe, with water, acetone and/or ethanol in order to remove oil, grease, and like surface contaminants. Additionally, after being cleaned., the door skin exterior surface generally will be coated with a base or ground coat, such as by spray application, in order to provide a uniform color on which the additional image components are printed.

Figure 4:
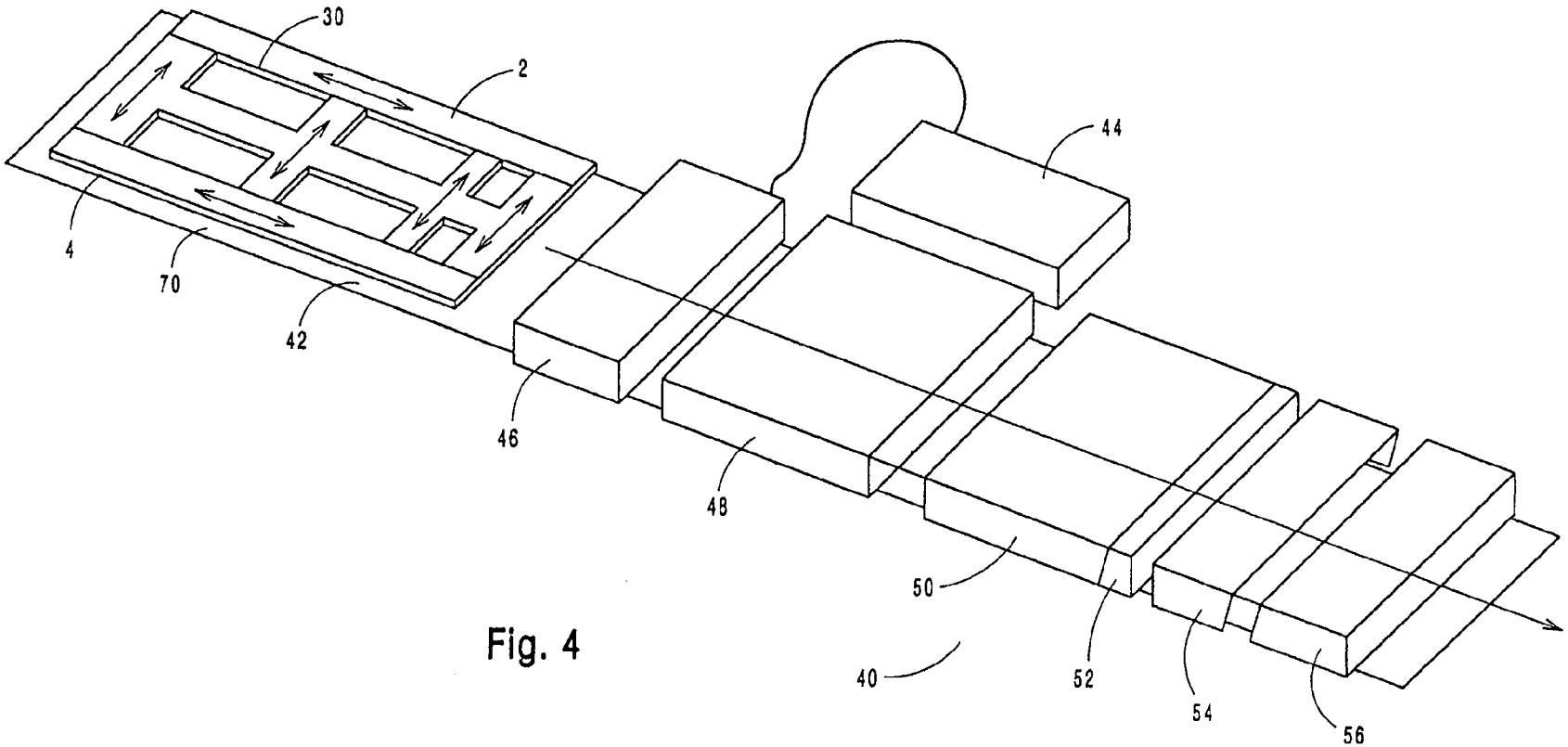
FIG. 4 is a schematic view of a printing apparatus according to an embodiment of the present invention.

As best shown in FIG. 4, a printing apparatus 40 is provided for printing an image on an object, such as door 10. Apparatus 40 preferably includes a bed 42 for supporting door 10. Preferably, bed 42 can support a plurality of objects to be printed.

Optionally, the bed 42 may support a pre-assembled door skin 14, 16, i.e., before attachment of door skins 14, 16 to peripheral frame. Bed 42 may also include means for arranging objects on bed 42, such as a loading tray. However, the arrangement and positioning of the objects to be printed may also be carried out manually.

Preferably, door 10 includes door skins 14, 16. Although not shown, the door 10 may alternatively comprise a solid unitary member. After providing door 10, an image to be printed on an upper face 2 of door 10 is selected. A plurality of images and constituent elements or components of the image (or "image components") may be stored in a memory of a controller 44, such as a personal computer (PC). Controller 44 may include a library of images or prints, which are applied as image components as described herein to obtain a more realistic effect. Next, the dominant color of the selected image is selected, either by controller 44 or manually by a user. The dominant color is the color or tone in the selected image that is most prevalent in the image when viewing the image in its totality. A color related to the determined dominant color is determined. The color related to the dominant color is generally a shade of the dominant color. (For example, tan is a color related to a dominant color of a darker brown). The color related to the dominant color will enhance the appearance of the selected image when the selected image is printed over a groundcoat of the related color.

Preferably, the positioning of upper face 2 to be printed is registered with controller 44 by identifying the location and positioning of door 10 on bed 42. In this way, controller 44 advantageously knows where the object to be printed (e.g., door 10) is and can then adjust the position of the image components to be printed accordingly. Registering of the upper face 2 may comprise, for example, locating a feature on door 10, such as the location of a channel 30, or some other descriptive or distinct feature on the object as a registration point. An object may include more than one registration point, such as several channels 30. It will be appreciated that registration is of particular importance where the image components have been manipulated so that the printed image components correspond to particular features of the object. For example, the image components may be manipulated so that a greater density or darker color is printed in channels 30. Features of the object, such as an embossed grain pattern on the surface of the object, or stiles or rails of a door, may act as registration points affecting the print image.

Apparatus 40 also preferably comprises means for applying a ground coat to upper face 2 of door 10, such as a spray coating device 46, prior to ink jet printing door 10. A ground coat of paint of the related color is applied to upper surface 2 and lower surface (not shown) of door 10 by spray coating device 46. This provides a uniformly colored surface. For example, this coating may comprise a mahogany colored paint that is applied to upper face 2, which is positioned uppermost and faces spray coating device 46. Various methods of applying the related color to upper face 2 may be employed by spray coating device 46, such as by manual spray gun or by robotic sprays. Preferably, the coating of the related color is applied to upper face 2, as well as the opposing face on door 10 (i.e. the exteriorly disposed faces of skins 14 and 16). In addition, side edges 4 of door 10 may also be coated with the related color.

The ground coat is preferably applied to door 10 by a method other than ink jet printing, since ink jet ink is relatively expensive. In addition, this primary ground coat may be the background color and/or tone for a particular image to be printed. For example, if a wood grain pattern is being printed, the ground coat may be the background tone of the woodgrain pattern. The use of paint or other non-ink jet ink for the background tone may be appropriate if a "dark wood" is to be printed onto a light colored surface. Otherwise, a relatively large amount of ink jet ink is used for the entire image, thereby increasing manufacturing costs. It is therefore preferred that the ink-jet ink be used for printing only the wood grain or stain glazed patterns and optionally background tone of the grain for minimizing manufacturing costs. As used herein, wood grain patterns and images are a series of corresponding lines simulating wood vessels and ticks as found in natural wood, and may include width, coloration and density variations.

The ground coat will have a high surface tension, preferably in the range of 38-50 surface dynes and may be applied in a smooth coat without dry spray to maximize ink droplet formation. If the ground coat is not formulated for a smooth application, micro-cracks may form on surface of the skin, resulting in a foggy or non-continuous final print. Spread of the ink droplets on the surface of the ground coat is also important. Good absorption of the ink results in a more continuous print with more brilliant color definition.

Alternatively, ink jet ink may be used to enhance or modify the color of the ground coat applied by coating device 46. However, a ground coat preferably is selected having a color that is similar to that of the desired background tone, so that the amount of ink jet ink used is again minimized. Using differing ground coat colors, it is possible to simulate different types of wood using the same wood grain image. It should be noted that if desired, the entire image to be printed may be done using ink jet printing technique, thereby eliminating the necessity for coating device 46.

A second ground coat optionally may also be applied, particularly when the object to be printed includes one or more channels 30, such as with door 10. In the illustrated embodiment, the secondary ground coat is applied into channels 30. Preferably, this secondary ground coat is also a color related to the dominant color of the selected image, but is generally a darker shade compared to the primary ground coat. In this way, the secondary ground coat provides a suggestion of shadowing in channels 30 of upper face 2 and masks any slight decrease in print quality that may occur on the irregular surfaces of channels 30. The darker ground coat tone provides a richer and greater depth appearance compared to printing on a lighter toned ground coat, and reduces the amount of ink jet ink needed.

In addition, there is a tendency for the print density to decrease in optional contoured portions, such as channels 30. Controller 44 aligns the object to be printed by registering particular features of the object, and then applies a print grid to the object, which determines the placement of the ground coat pigments and ink jet ink. The print grid is a two dimensional construct used by controller 44. However, the object to be printed is three-dimensional. As such, when the print grid overlays the object, contoured portions may not be adequately accounted for with respect to print density of ink and/or pigment needed. Specifically, the surface area of contoured portions of the object may not be accurately accounted for, causing "stretching" of the print grid which gives an apparent lower density of ink required for printing the image. However, a substantially constant density of the printed image is preferred in order to achieve a high image quality. If a regular printing frequency were used for recessed portions, the print density in such recesses might be less than elsewhere on the surface. The density can be made constant by, for example, increasing the density of ink to be printed in channels 30 (or on a projection), by changing the color of the ink printed in channels 30 and/or adjusting the image to be printed, for example by adjusting the print grid. The density of the ink to be printed may also be adjusted by adjusting the speed of print bed 42. For example, density of the ink may be increased by decreasing the speed of print bed 42, or density of the ink may be decreased by increasing the speed of print bed 42.

The secondary ground coat compensates for such reduced print density and/or lessens the visual impact of any imperfections in the image by darkening channels 30. Therefore, the secondary ground coat preferably has a color that is darker than the primary ground coat color. The secondary ground coat may be non-ink jet ink, such as paint or stain, which is cheaper than ink jet ink, and may be applied by spraying or a robotic device as long as surface tension of the ground coat is maintained, preferably in the range of 38-50 surface dynes.

The first and second ground coats are then cured or dried at a drying station 48. Drying station 48 may comprise an induction radiation heater for drying the ground coat, or some other pigment-drying device known in the art. Door 10 (or another door skin 14, 16) is then forwarded to a printing station 50 (described in detail below) and the selected image components are ink jet printed on upper face 2 as described below. Although not shown, it should be understood that the ground coat(s) may be pre-applied in a separate process, i.e., the coating device, drying station 48, and printing station 50 need not be arranged for continuous processing with one another.

Printing of a first component of the image (or first image component) at printing station 50 is preferably conducted with an ink jet printer using a UV-curable ink, for example Sericol UviJet curing ink. The UV-curable ink is then cured using a UV curing lamp 52, which is preferably incorporated into printing station 50.

A first UV curable, transparent coat or protective layer may then be applied to upper face 2 of door 10 at a topcoat station 54. Topcoat station 54 includes a device for applying the first protective coat onto door 10, such as by spraying, thereby covering the printed first image component on upper face 2. The first coat may comprise, for example, PPG Flexicron UV solvent-based exterior topcoat consisting essentially of 85 percent 20 degree sheen and 15 percent flat gloss sprayed at a fluid pressure of 8 psi. The thickness of the first coat is not particularly limited, although an exemplary range is 0.3 (7.6 microns) to 0.4 mils (10.2 microns). The first protective coat is then dried at a UV topcoat curing station 56 using conventional curing techniques, dependent on the first coat formulation. We have found that the gloss of the first and second protective coats should be less than typically utilized in order to provide a more realistic appearance. If the gloss is too high, the resulting finished door will have an artificial glossy appearance.

The protective layers are preferably transparent. As referred to herein, the term transparent means optically transmissive so as to allow the natural eye viewing of the image components printed under the coating. Although transparent preferably means clear and without color, within the scope of this disclosure the term transparent may encompass coatings having a tint of any color that is not dense and opaque enough to significantly impede the transmission of light for viewing of the image.

A second component of the image (or second image component) is then printed on the first protective coat and dried, after which a second protective coat is applied over the second image component. Application of the second image component and the second protective layer may be comprise returning the door 10 to a position upstream of printing station 50 (and optionally but not necessarily upstream of the spray coating device 46 and drying station 48), then passing door 10 with upper face 2 facing upward through the printing station 50 for printing the second image component, the drying station 52 for drying the second image component, the topcoat station 54 for applying the second protective coating over the second image component, and the curing station 56. Alternatively, separate downstream printing, drying, and topcoat stations (not shown) may be provided for applying the second image component and the second protective coat.

It is preferred that the first image component and the second image component be substantially registered with one another to provide a visually acceptable complete image that does not appear to comprise separate and distinct components. For example, the image registration may be offset by, for example, not more than 0.5 inch (1.27 cm), preferably not more than 0.125 inch (0.3175 cm). Still more preferably, the first and second image components are placed in exact registry. The first and second image components may comprise exact copies of one another, or may differ from one another in part or in whole. The first and second image components may, for example, complement one another, as in the case in which the first image component comprises a wood grain vessel or stain glazed pattern and the second image component comprises wood grain tick and/or knot images. One or both of the image components may take the form of, for example, a pattern, random design, a tangible object or objects, or combinations thereof. The printing ink for printing the second image component may be the same as or different from the printing ink of the first image component.

The first and second coats may be made of a material or materials that are the same as or different from one another. The first and second coats may be, for example, a clear varnish. The respective thicknesses of the coats may be the same or different from one another. Although the thickness of the second coat is not particularly limited, a representative thickness is approximately 0.5 mils (12.7 microns).

The low sheen protective topcoat provides a realistic finish. Because the first and second image components have a depth due to the thickness or depth of the ink forming them, the resulting product has a rubbed natural, textured wood-like feel and is not smooth to the touch. The positioning of a clear coat between the print image components adds translucence, reflectance, and a depth of print. The second coat protects the printed images from, for example, mechanical damage, and may also improve color fastness of the printed product. In addition, it has been found that, although substantially clear, the UV protective topcoats unify the various elements of the printed image and masks any graininess produced by the individual droplets of ink jet ink.

Door 10 may then be turned over to expose the face opposite upper face 2 (the exteriorly disposed face of skin 16) or alternatively another door skin may be prepared for printing. The coating and printing steps may then be repeated by passing door 10 through the same apparatus 40, or by using a different apparatus. It will be appreciated that the opposing sides of door 10 may be coating and printed to have identical or different images (e.g., figures and/or patterns). It will also be appreciated that different methods could be used to provide the initial and/or final coating steps described herein. For example, the coating or uniform color for printing could be provided using a toned groundcoat or overlay, in which case the preferred coating is a water-based paint.

Figure 5:
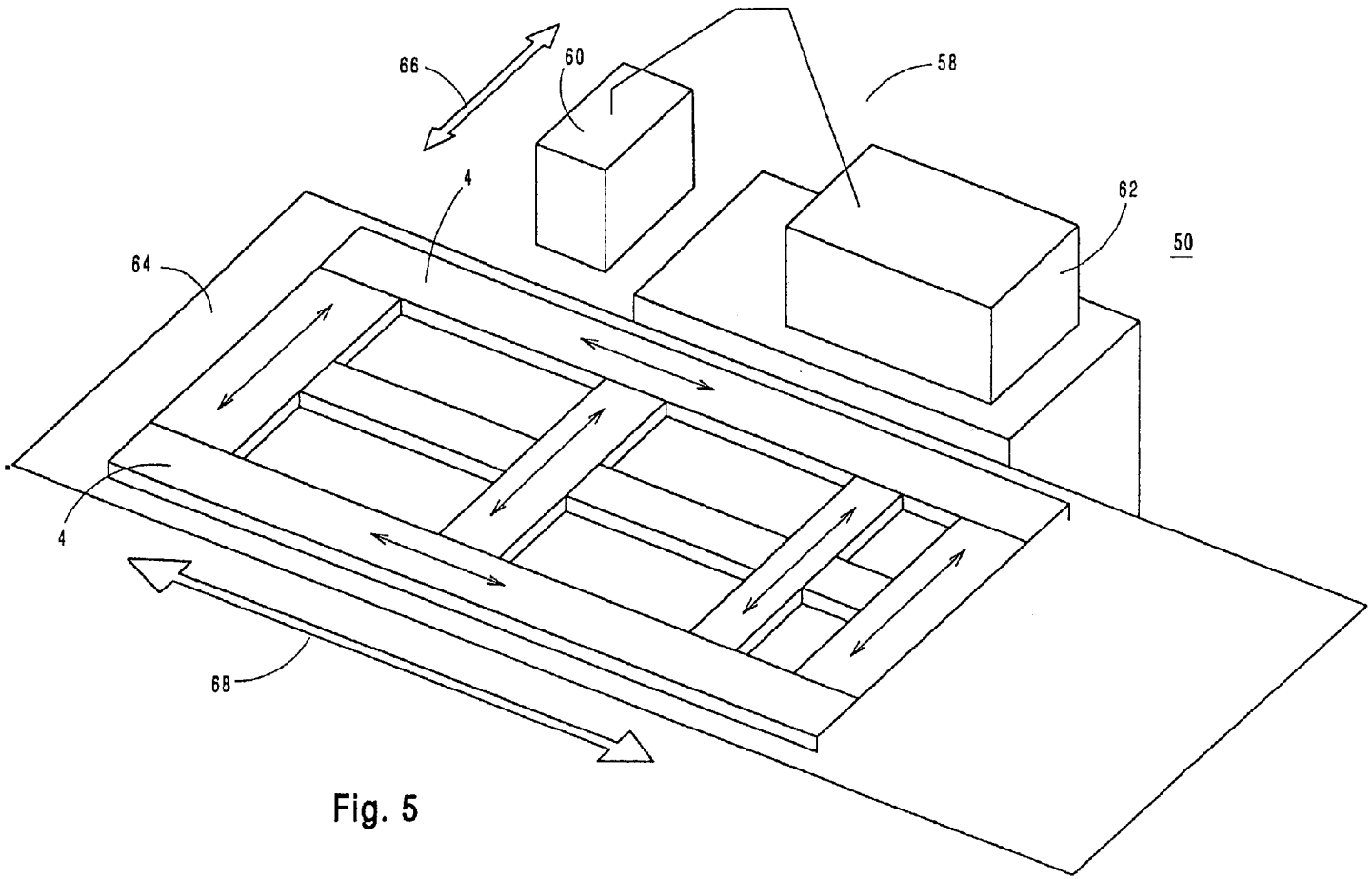
FIG. 5 is a schematic view of a printing station according to an embodiment of the present invention.

Printing station 50 will now be described in detail. As best shown in FIG. 5, printing station 50 includes a printer 58. Printer 58 has at least one ink jet printhead 60, which is connected to a print control device 62, and a printer bed 64. Printer bed 64 may be operably associated with bed 42 of printing apparatus 40, or bed 42 may be integrated with printer 58. Print control device 62 includes an image processor for creating the image. For example, the image processor may create an image based on a photo of a wood grain pattern input into print control device 62. Each image might be created from scratch for each type and size of object. Typically for a door, the individual rails, stiles and panels will be made using different photo images and assembled on graphics software by print control device 62. Then, color density manipulations and adjustments may be made if needed, so that the image accurately simulates wood grain and compensates for any shallow angles of printing.

The imaging separates the initial photographed image into multiple components based upon the end product desired. For example, we have found that a realistic image is created if the ticks of the wood grain are removed, so that the resulting first image component comprises the relatively large "vessels" of the wood grain. The ticks are then applied over the vessels and their protective coat. The ticks are relatively small and delicate and typically are colored somewhat differently than the vessels. In this way the vessels and ticks more accurately represent a wood grain, such as mahogany, oak, etc.

Where a particular image is to be printed in a channel or projection of an object, the object should be in the correct position before printing. In some cases, it may be possible to position the object in exactly the same position every time in printer 58. However, apparatus 40 preferably includes a means for registering the position of the surface to be printed, such as with a laser optical device operably associated with printer control device 62. In this way, the image to be printed may be accurately aligned with a print grid used by printer control device 62. For example, the optical device may identify corners of door 10 or channels 30, and use the position information to align the image to be printed with the object within 1/64 inch (0.4 mm). In this way, artwork may be tailored for each given object size, such as a particular door design or shape, by registering to the molded features of the object, or even the embossed grain texture on a molded or a flush object.

Printhead 60 is mounted for movement in a direction perpendicular to the direction of movement of door 10. Arrow 66 shows direction of movement of printhead 60, and in this way, printer bed 64 is moveable relative to printhead 60. Relative movement encompasses moving the printhead while maintaining the print bed stationary, moving the print bed while maintaining the printhead stationary, or moving both the print bed and the printhead.

Preferably, printer 58 is a flat bed printer, such as the Eagle 44 scanning moving bed ink jet printer of Inca Digital Printers Limited of Cambridge, United Kingdom. Door 10 may be arranged on printer bed 64, and printer bed 64 is able to move longitudinally backwards and forwards relative to printhead 60, which moves transversely (i.e. perpendicular to the direction of movement of printer bed 64). In this way, the whole width and length of door 10 may be effectively printed.

Figure 6:
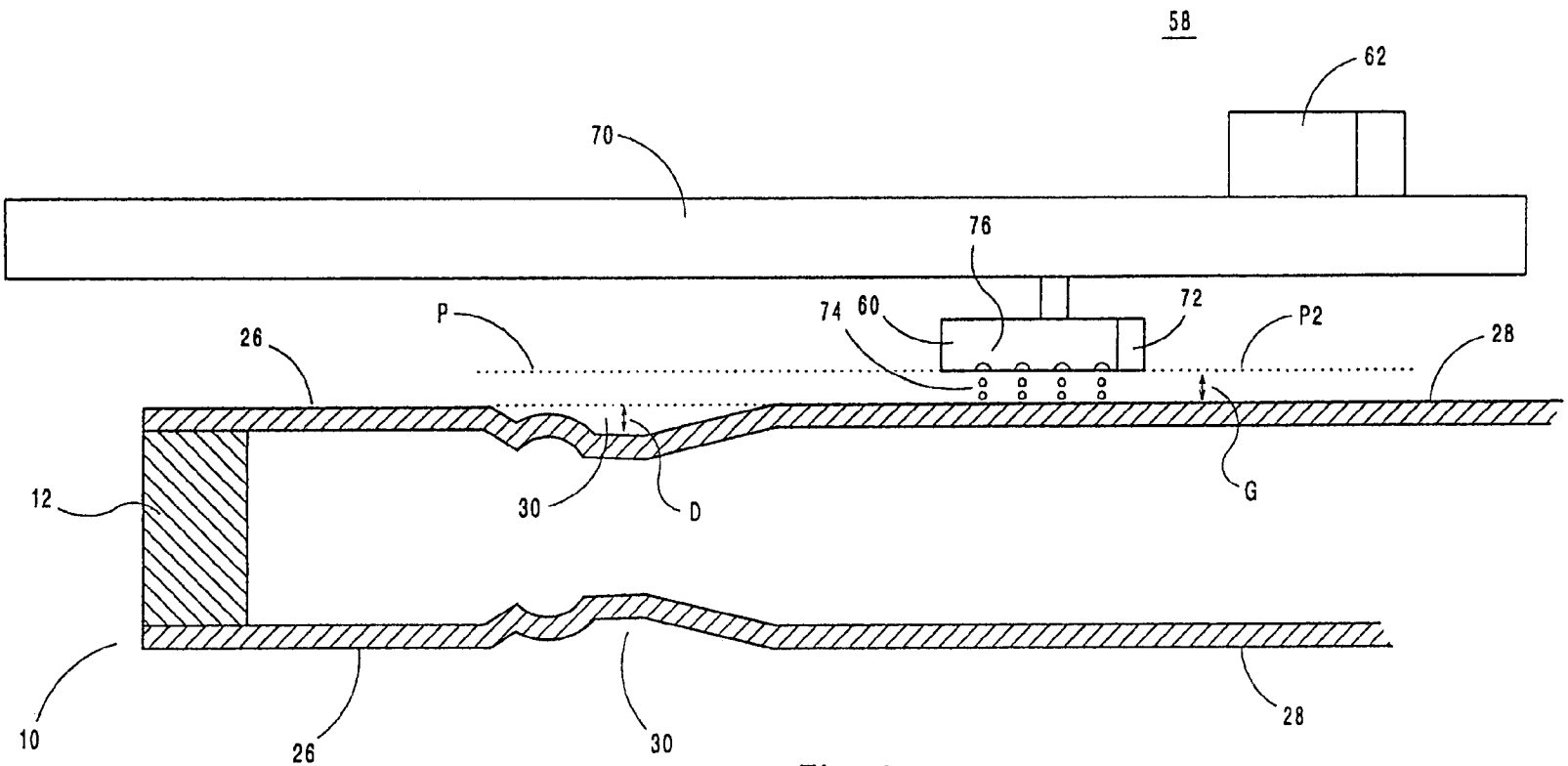
FIG. 6 is a schematic, partially sectioned view of a printer applying ink to a door having a channel.

As best shown in FIG. 6, printer 58 may include a gantry 70 for supporting printhead 60. Gantry 70 provides for lateral movement of printhead 60 under the control of print control device 62, as described above. The gantry 70 is also preferably slidable longitudinally along the length of the print bed. Controller 44 of apparatus 40 preferably controls print control device 62. In this way, data stored in the memory of controller 44, including positioning information and image data, may be communicated to print control device 62. In addition, printhead 60 preferably includes a UV curing lamp 72 for drying and curing the ink jet ink. Alternatively, a separate curing station 52 may be provided, if included in the printer unit. Ink jet ink droplets 74 are emitted from nozzles 76 on printhead 60.

The nozzle outlets of printhead 60 travel in a plane P2 that is separated from plane P of door 10 by a space G. Therefore, in the event the entire surface of the object is not planar, the distance traveled by ink droplets 74 emitted from nozzles 76 varies depending on whether printhead 60 is over a planar portion 26 (or panel portion 28) or over a channel 30. The maximum printing distance between nozzles 76 and upper surface 2 of door 10 is therefore equal to the depth D of a channel 30 plus space G (D+G=maximum printing distance). For example, if depth D is 12 mm, and gap G is 3 mm, the maximum printing distance will be about 15 mm. The maximum printing distance is preferably less than about 25 mm, more preferably less than about 15 mm. Commercially acceptable images are obtained when the maximum printing distance is about 12 mm or less. It is envisioned that greater depths could be printed successfully by droplet size, space distance and depth manipulations, and therefore it should be understood that the present invention is not restricted with regard to the depth of the recess being printed. However, if the distance (D+G) is too great, the placement control of droplets 74 may become unacceptable in some cases, causing blurred images in channels 30.

Preferably yet optionally, the object to be printed primarily includes planar portions and/or recesses, but few, and more preferably no, projections. The presence of projections can lead to large recessed areas which may result in poor ink coverage. Thus, it is preferred that nozzles 76 print a majority of upper face 2 at a closer distance (i.e., G as opposed to D+G). To compensate for any potential visual imperfections, the density of droplets 74 that are printed in channels 30 is preferably greater than elsewhere on face 2. In addition, increased printing density in recessed areas compensates for any "stretching" of the print grid, as explained above.

To darken the channels 30, the printing density may be increased either before or after printing an initial image. A different density or color of droplets 74 may be applied to channels 30, such as by a spray application of a groundcoat or paint, optionally followed by a wiped or sprayed stain. Alternatively, the ovalo or recessed area may be rendered by building a darker tone into the registered ink jet artwork.

Nozzles 76 preferably have a diameter of about 20 μm or more, preferably about 30 μm or more, more preferably about 40 μm or more. As such, droplets 74 will have a diameter approximately the same as the diameter of nozzles 76. For example, a Spectra NovaJet 256 printhead may be used, which creates droplets having a diameter of about 40 μm. By providing that droplets 74 are relatively large, for example having a diameter greater than 20 μm, preferably not less than 25 μm, preferably greater than 30 μm, more preferably greater than 40 μm, it has been found that the effects of the relatively long distance of travel of droplets 74 (i.e. space G as well G+D), are reduced and, surprisingly, accurate placement of droplets 74 is achieved, resulting in a high quality image. Preferably, the ink that forms droplets 74 is a pigment-based ink that is UV curable, and therefore is cured almost immediately after its application by UV source 72. Several inks suitable for this use are produced by Sericol, Inc. of Kansas City, Kans., under the brand name UviJet.

The movement of printhead 60 relative to upper face 2, and the shape of channels 30 are such that droplets 74 can be printed onto substantially the whole surface of channels 30, even if channels 30 are relatively deep (for example, 10 mm) and sloped sidewalls 34 and 36 are relatively steep (such as 75 degrees relative to plane P). This is achieved by adjusting the relative speed of print bed 64, and/or by adjusting the pitch of nozzles 76 relative to plane P2 (for example the nozzles could be tilted), and/or the angle of upper face 2 of channels 30. This defines the incident angle at which droplet 74 is emitted from nozzle 76 relative to upper face 2. Preferably, a droplet 74 is emitted from nozzle 76 at an angle less than 20 degrees from perpendicular relative to printer bed 64.

The selected first image component is printed onto upper face 2 of door 10 and the first protective coat in several lateral passes across the width of door 10 by printhead 60. In addition, each pass may include the use of more than one printhead 60 and/or more than one row of nozzles 76, so that each pass may effectively print in more than one set of print grid positions. Those skilled in the art recognize that nozzles 76 emit droplets of various desired colors in order to create the correct printed color.

Figure 7:
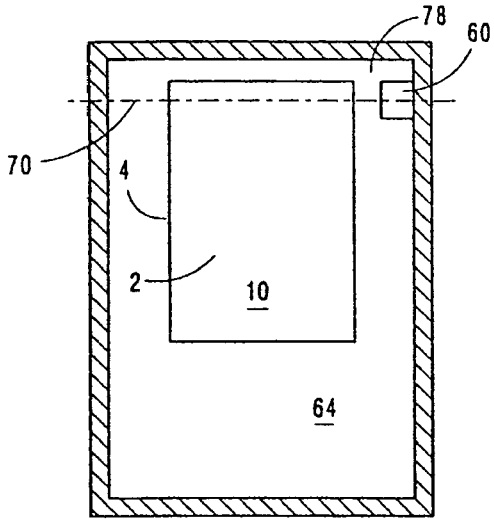
FIGS. 7-12 show schematically a method of ink jet printing a door according to an embodiment of the present invention.
Figure 8:
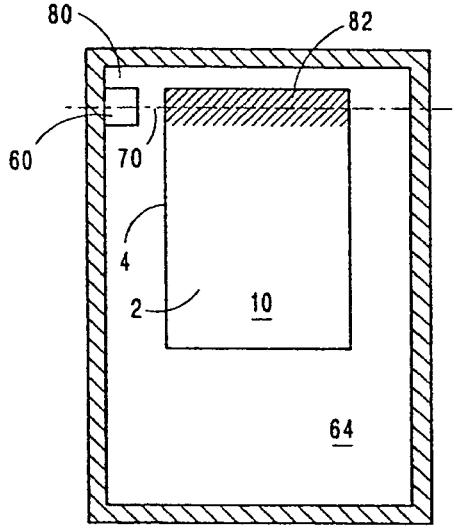

The relative movement and printing paths of printhead 60 relative to the surface being printed, e.g., door 10, is further explained with reference to FIGS. 6-12. Door 10 having upper face 2 and side edges 4 is supported on bed 64 of printer 58. Bed 64 is movable relative to printhead 60. For the purposes of this example, it will be assumed that the bed is movable longitudinally, although it is within the scope of the invention to maintain bed 64 stationary and move the printhead 60 longitudinally. Bed 64 moves under the control of print control device 62 with respect to gantry 70 and printhead 60. Ink jet droplets 74 are applied to door 10 in vertical strips running perpendicular to gantry 70. Thus, to print an image component that covers upper face 2, printhead 60 passes multiple times across the width of door 10. FIG. 7 shows printhead 60 in a first position 78 adjacent door 10 and movable bed 64 holding an edge of door 10 beneath printhead 60, so that a first strip of an image component can be applied to door 10 next to one edge thereof. FIG. 8 shows printhead 60 moved to a second position 80 and a first strip 82 of ink that has been applied to door 10. Printhead 60 includes a UV source 72 that illuminates ink applied to door 10. Thus, the ink of first strip 82 is cured almost immediately after it is applied to door 10.

Figure 9:
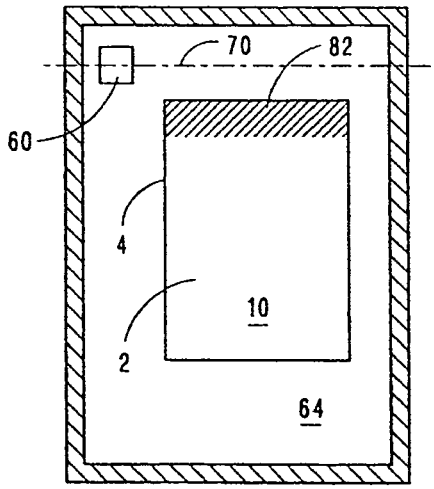
Figure 10:
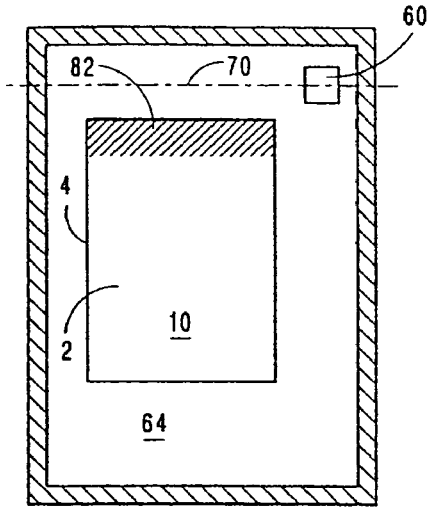
Figure 11:
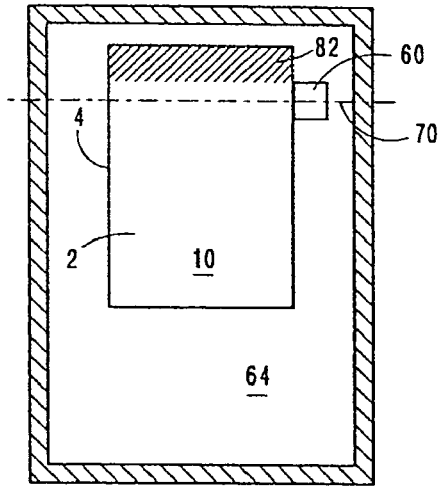
Figure 12:
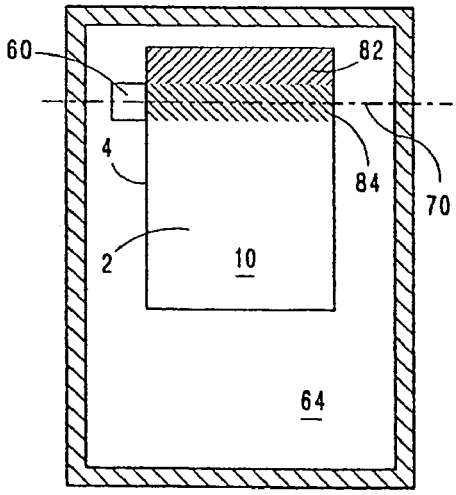

FIG. 9 shows door 10 moved away from printhead 60 and gantry 70 so that printhead 60 can be rapidly moved from second position 80 to first position 78 as shown in FIG. 10; without danger of accidentally coming into contact with door 10. Because the door 10 or the door skin 14 remains fixed, then accurate registration of print head 60 relative to the door can be achieved. Printing in one direction also allows for curing of UV curable ink using a single UV source 72. FIG. 11 shows door 10 moved so that an unprinted portion thereof adjacent to first strip 82 underlines gantry 70, and, as shown in FIG. 12, a second strip 84 of an image is ink-jet printed on door 10 adjacent first strip 82. These steps are repeated until the selected image component has been completely formed on door 10. During all of the passes, printhead 60 is maintained at a constant distance from the plane P of planar portions 26 of door 10, even when printhead 60 is passing over channels 30.

A preferred drop velocity of droplets 74 is about 8 m/s and a typical velocity of bed 64 is 1.5 m/sec. As such, the perpendicular of a printed surface should preferably be no less than, for example, 20 degrees from the path of the incident droplet 74 relative to the surface being printed. This is sometimes particularly relevant for the small areas, for example, little chamfers and ledges at the edge of moldings. In some cases, it is possible to compensate for angle by increasing the density of droplets 74 printed in a given area according to the relative angle (typically density of print should be multiplied by a factor of 1/cos of the angle between the perpendicular to the surface and the path of the incident droplet relative to the surface). This can be done by standard color management techniques, but accurate registration may be needed. Preferably the surface is such that the angle between adjacent regions of the surfaces to be printed is less than 90 degrees, preferably less than 85 degrees, preferably less than 80 degrees. For example, sloped sidewalls 34 preferably extend downwardly at an angle A of 80 degrees or less relative to plane P, as shown in FIG. 3. This ensures adequate ink coverage of all contoured portions, achieving a high quality image.

It is generally believed that smaller droplet sizes produce higher quality images. However, when printing on a substrate having depressions, molded channels, or protrusions, it has been found that the opposite is true. As noted above, the placement of smaller droplets is often difficult due to air currents, slipstream effects, and air viscosity. However, relatively large droplets 74 have sufficient mass and momentum to remain relatively unaffected by such turbulence or other adverse effects. As such, the use of relatively large droplets 74 creates a high quality image, even on contoured surfaces such as upper face 2 of door 10.

It is possible to obtain high quality print images, even photographic quality print images, by following the method of the present invention. (Note that "photographic quality" refers to very high quality images that closely resemble a photograph in image quality and color accuracy. Posters or reproductions of artwork, for example, are generally of photographic quality as this term is used herein. Prints that are blotchy or that include color inaccuracies or uneven edges are not included within this definition.)

In a preferred embodiment of the invention, the disclosed method can be used to create a simulated wood grain pattern, even if the surface to be printed already comprises real wood. For example, the surface to be printed may comprise low quality plywood. By use of methods described herein, the plywood may be made to resemble a more expensive wood, such as cherry wood. This may be achieved, for example, by staining or painting the plywood with a "cherry" color ground coat. Then, a wood grain pattern (e.g., cherry wood) is applied to the painted plywood in multiple printing steps, e.g., a step of printing wood grain vessels as a first image component and a subsequent step of printing wood grain ticks as a second image component, preferably substantially registered with the first image. Interposed between the printing steps is a coating step. The use of real wood such as plywood in the printed area has the added advantage that the plywood already has a wood texture that gives further perceived quality to the simulated "cherry wood".

When printing a wood grain pattern, preferably ink having color tones found in natural wood is used. This helps to reduce the amount of ink jet ink needed, and possibly the number of ink colors required, and therefore the number of printheads 60 required. Preferably a standard CMYK ink set is used in the disclosed method.

Figure 13:
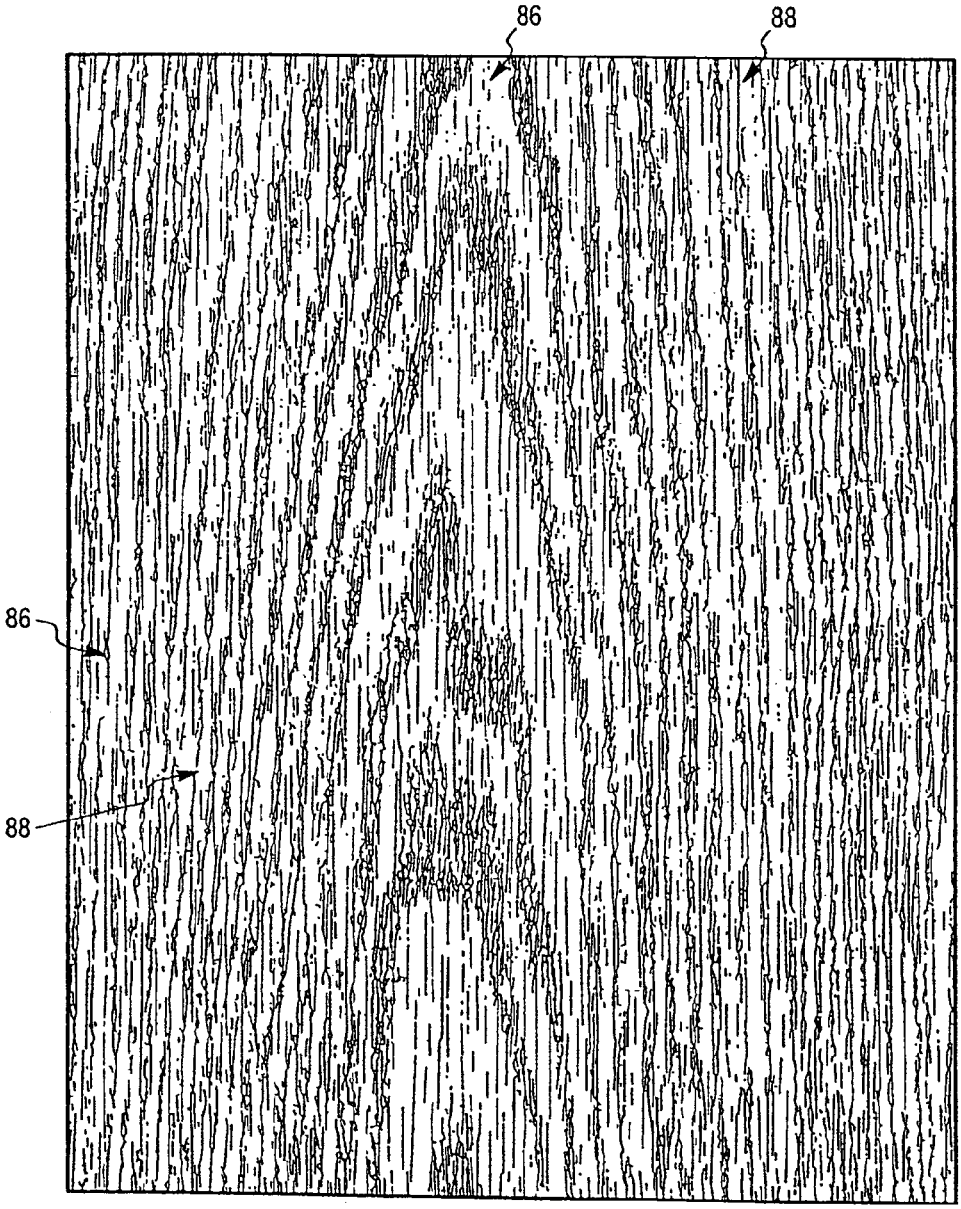
FIG. 13 shows a wood grain pattern printed using embodied methods of the present invention.

A representation of an example of a wood grain pattern is best shown in FIG. 13. The pattern includes detail of the heartwood and sapwood of a particular grain pattern. This image can be precisely duplicated based upon photographic images. Although the application of a ground coat prior to printing the wood grain pattern is sometimes preferred, it is not necessary. The background tones 86 of the wood grain image with the initially prepared ground coat. The darker lines such as vessels 88 are then ink jet printed as the first image component and markings such as ticks 89 are subsequently printed as the second image component. The application of protective topcoat between ink jet printing steps and following the final ink jet-printing step controls gloss, provides long term performance, provides depth impression, and provides the textured feel of real wood.

Figure 14:
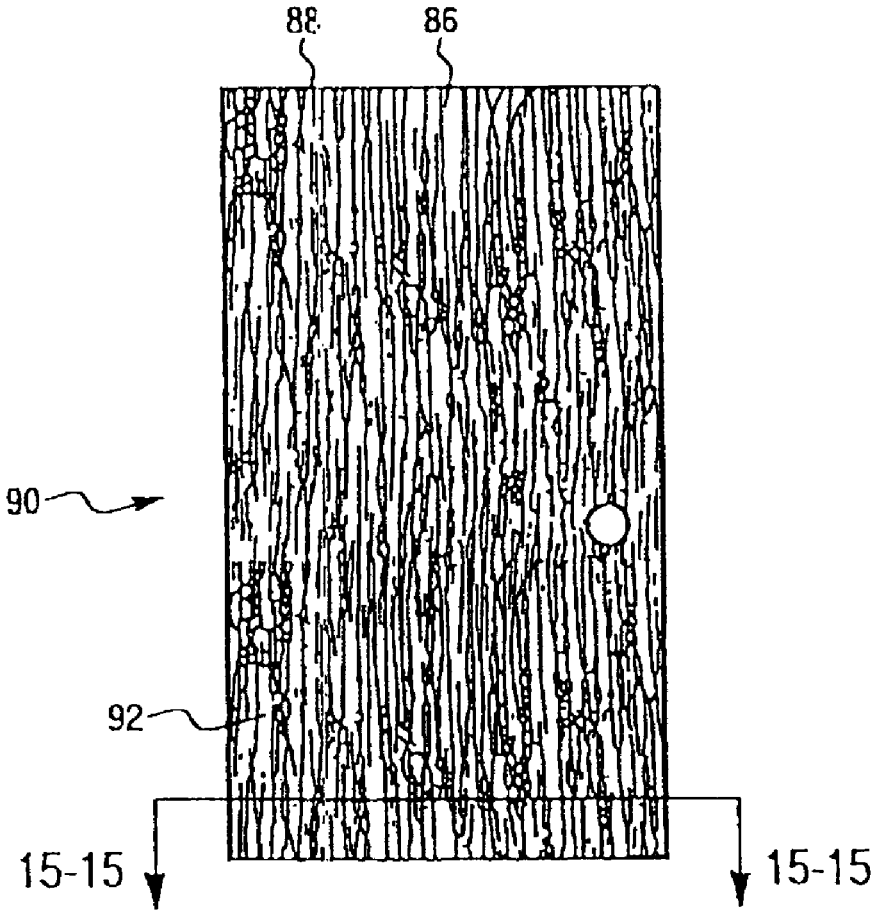
FIG. 14 is a front elevational view of a flush door skin having a wood grain pattern ink jet printed thereon by an embodied method of the present invention.
Figure 15:
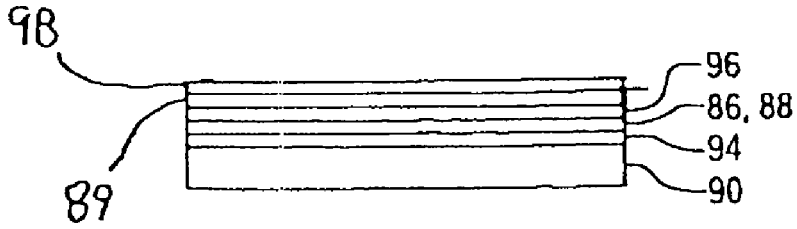
FIG. 15 is a sectional view taken through line 15-15 of FIG. 14 and viewed in the direction of the arrows.

A flush door 90 having a wood grain pattern printed on at least one face 92 of door 90 is best shown in FIGS. 14 and 15. The wood grain pattern includes background tone 86, a first image component of vessels 88, and a second image component of wood ticks 89. Using the method described above, a primary groundcoat 94 of paint, stain, or other pigment, having a color similar to background tone 86 is applied to face 92. Background tone 86 may then be further enhanced and colored by ink jet printing. In addition, the first image 88 is ink jet printed. A first protective coat 96 may then be applied to door 10 following ink jet printing of background tone 86 and the first image 88. Next, the second image 89 of wood ticks is printed on the first protective coat 96. A second protective coat 98 may then be applied to door 10 following ink jet printing of the second image 89 so as to cover the second image 89 and the first protective coat 96. The resulting printed door 90 has a high quality, photographic image of a natural wood surface. Further, the spacing of first and second print image components at different protective layers contributes to the formation of an overall image having depth.

Alternately, to reduce the amount of expensive ink jet ink used in the printing process, a primary groundcoat 94 having a color corresponding to the color of background tone 86 may be used, thereby eliminating the necessity of additional coloration with ink jet printing for background tone 86. Only the first image 88 is thus printed in the first inkjet printing step. Beneficially, this method reduces the amount of expensive ink jet ink needed, since less than half of face 92 needs to be coated with the ink jet ink. However, some of the fullness of the image obtained by inkjet printing both the background tone 86 and the first and second images 88 and 89 may be reduced.

Figure 16:
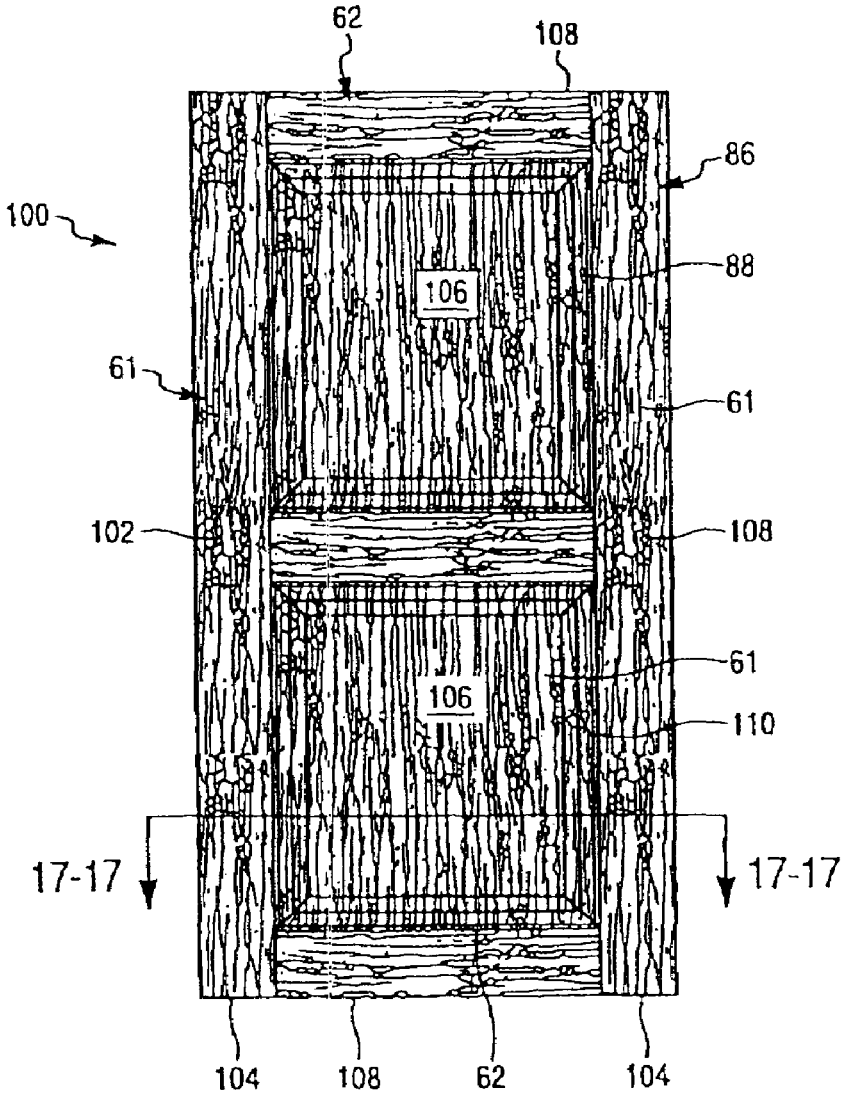
FIG. 16 is a front elevational view of a molded door skin having a wood grain pattern ink jet printed thereon with grain runs in two directions.
Figure 17:
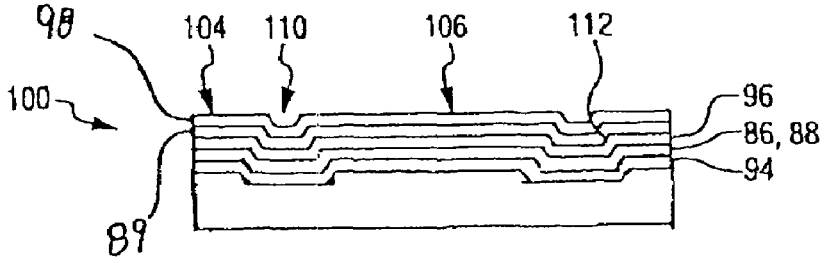
FIG. 17 is a sectional view taken through line 17-17 of FIG. 16 and viewed in the direction of the arrows.

Traditional rail and stile doors are formed with wooden elements each having wood grain running in the longitudinal direction of the element. Some of these elements are positioned at right angles to one another when a door is assembled, and, therefore, traditional doors may have wood grain running in two mutually orthogonal directions. As best shown in FIGS. 16 and 17, door 100 includes a wood grain pattern printed on at least one contoured face 102, and has the appearance of wood grain running in two directions to simulate the appearance of such traditional doors. As with door 90, door 100 includes background tone 86, vessel pattern 88, and wood ticks 89. However, background tone 86, vessel pattern 88, and wood ticks 89 are printed so that a first wood grain pattern G1 runs in a first direction on vertical stile portions 104 and panel portions 106, and a second wood grain pattern G2 runs in a second direction on horizontal rail portions 108. Because the stored image of wood grain pattern has wood grain running in two directions, this pattern can be printed in register to the design features of the molded door design or embossed textured pattern. The wood grain pattern may also be printed in channels 110 surrounding panel portions 106 in a direction corresponding to adjacent stile and rail portions 104, 108. Similar to door 90, face 102 of door 100 includes primary ground coat 94. Preferably, a darker secondary ground coat 112 is applied to channels 110 covering primary ground coat 94. Background tones 86 and vessel patterns 88 are then printed using ink jet printing techniques, followed by an application of a first topcoat 96, printing of the wood ticks 89, and application of a second topcoat 98. The result is a high quality image over the entire surface of contoured face 102 of door 100.

In some cases it will be sufficient for just the front and back faces of a door, such as exteriorly disposed surfaces of skins 14, 16, to be printed with a wood grain pattern. In other cases, it will be sufficient for just one face of a door to be printed with a wood grain pattern, for example, for a door leading from a house to an attached garage. However, side edges 4 of door 10 may also be provided with the wood grain pattern. Alternatively, a veneer could be applied to side edges 4.

Figure 18:
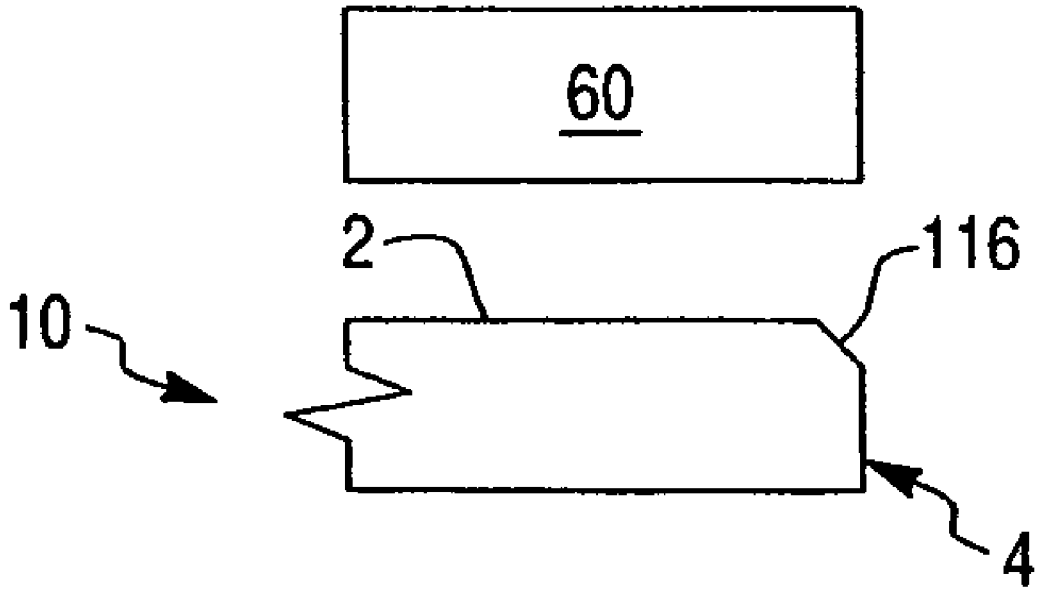
FIG. 18 is a schematic view of a printing arrangement with a door having a chamfer.

In a preferred embodiment, the corner of door 10, where upper face 2 meets side edge 4, includes a chamfer 116, as best shown in FIG. 18. The presence of chamfer 116 gives a better finish to door 10. A printhead 60, when located adjacent side edge 4, may extend slightly beyond upper face 2 and therefore print onto at least a part of the chamfer 116. This achieves high image and print quality of portions of upper face 2 adjacent edges 4.

Figure 19:
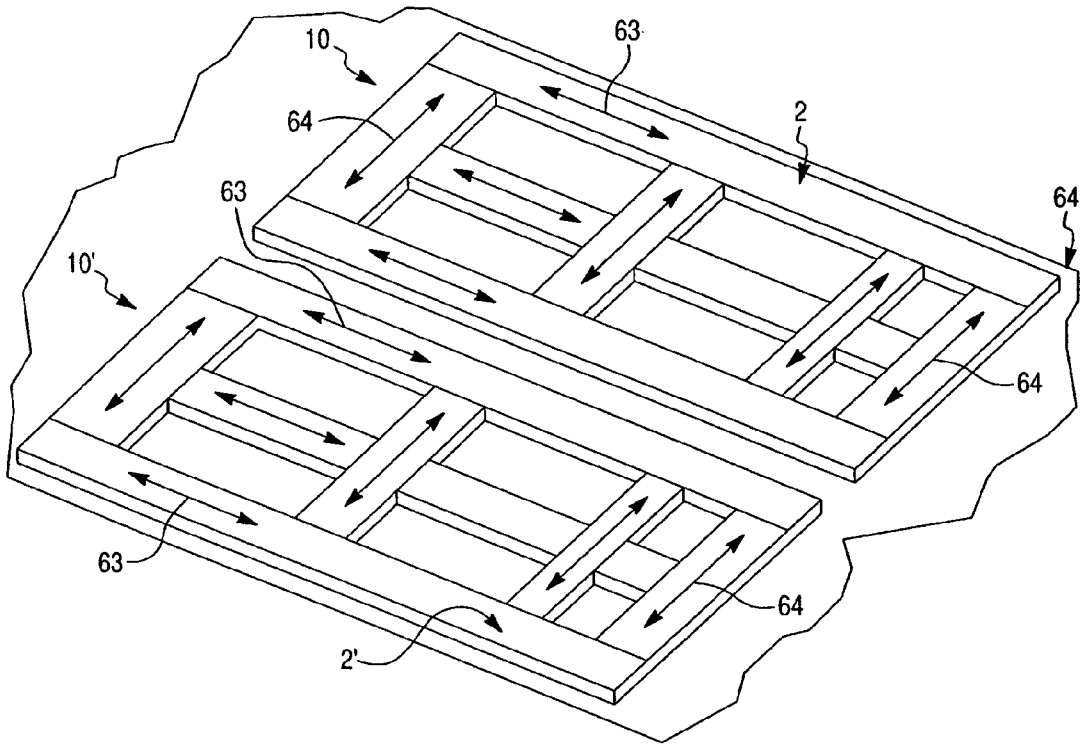
FIG. 19 is a schematic view of another printing arrangement for printing two doors simultaneously.

FIG. 19 illustrates a printing system for printing two doors 10 and 10' at the same time. The doors are placed side by side on bed 64. One or more printheads 60 may be provided to print the upper faces 2 and 2' of doors 10 and 10', respectively. In addition, a printhead may be provided for printing side edges of each door, as described above. As shown by arrows G3 and G4, image components of a wood grain pattern may be printed sequentially in a first and second direction. Ink jet printing permits precise placement of ink droplets 74, and therefore the printing of wood grain in directions G3 and G4 may be accomplished as the printheads pass over the combined width of both doors 10, 10' (just as described for door 10 in FIGS. 7-12). As described above, a protective coating is applied between the image component printing steps, wherein the doors may be removed from the print bed. Once the printing operation for upper faces 2, 2' is complete, doors 10 and 10' may be flipped to expose the unprinted faces, which may then be printed in a similar manner. A preferred ink jet ink used for this printing arrangement is Sericol UviJet UV curing ink.

Figure 20:
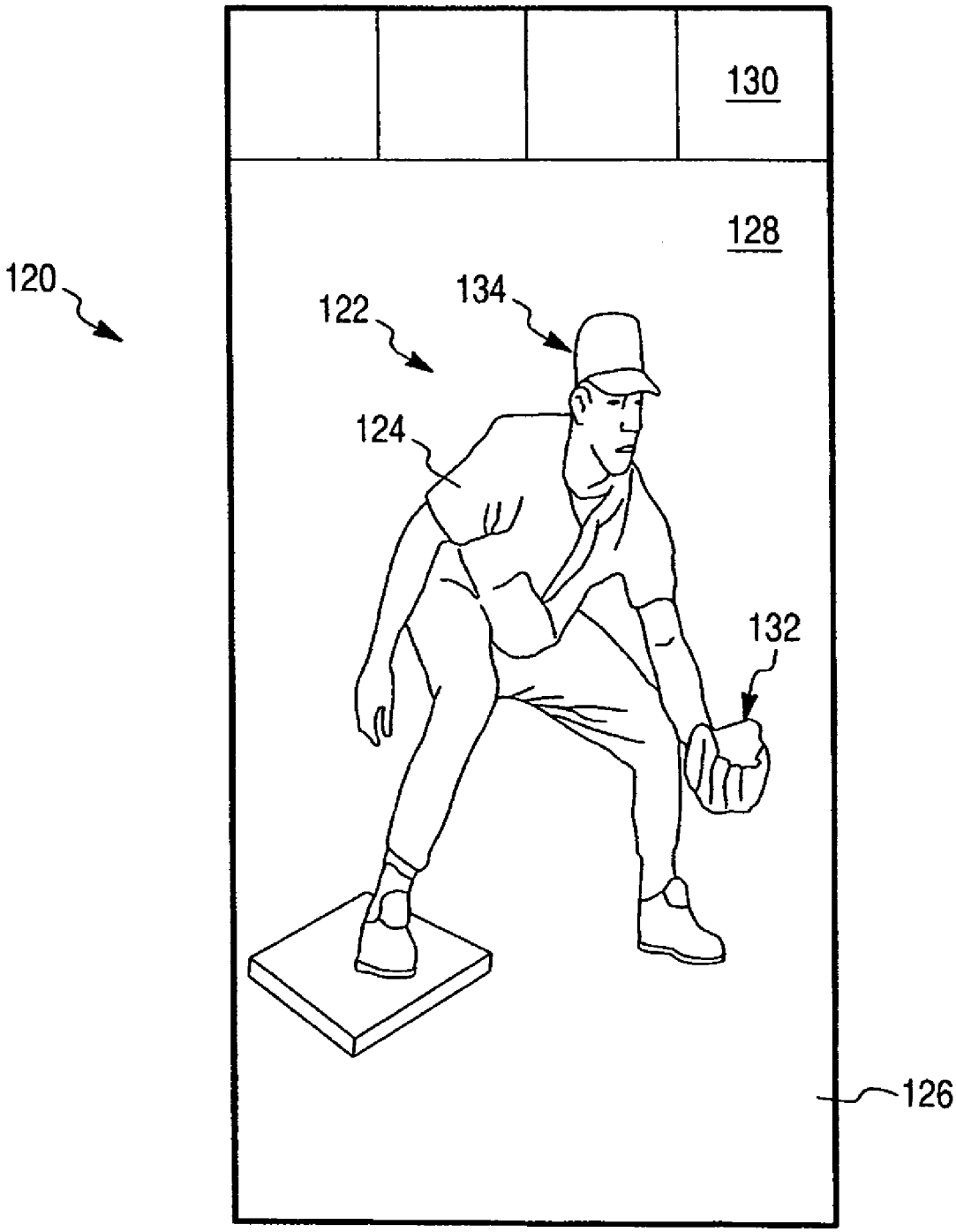
FIG. 20 is a front elevational view of a door having a graphic image printed thereon using an embodiment of the method of the present invention.
Figure 21:
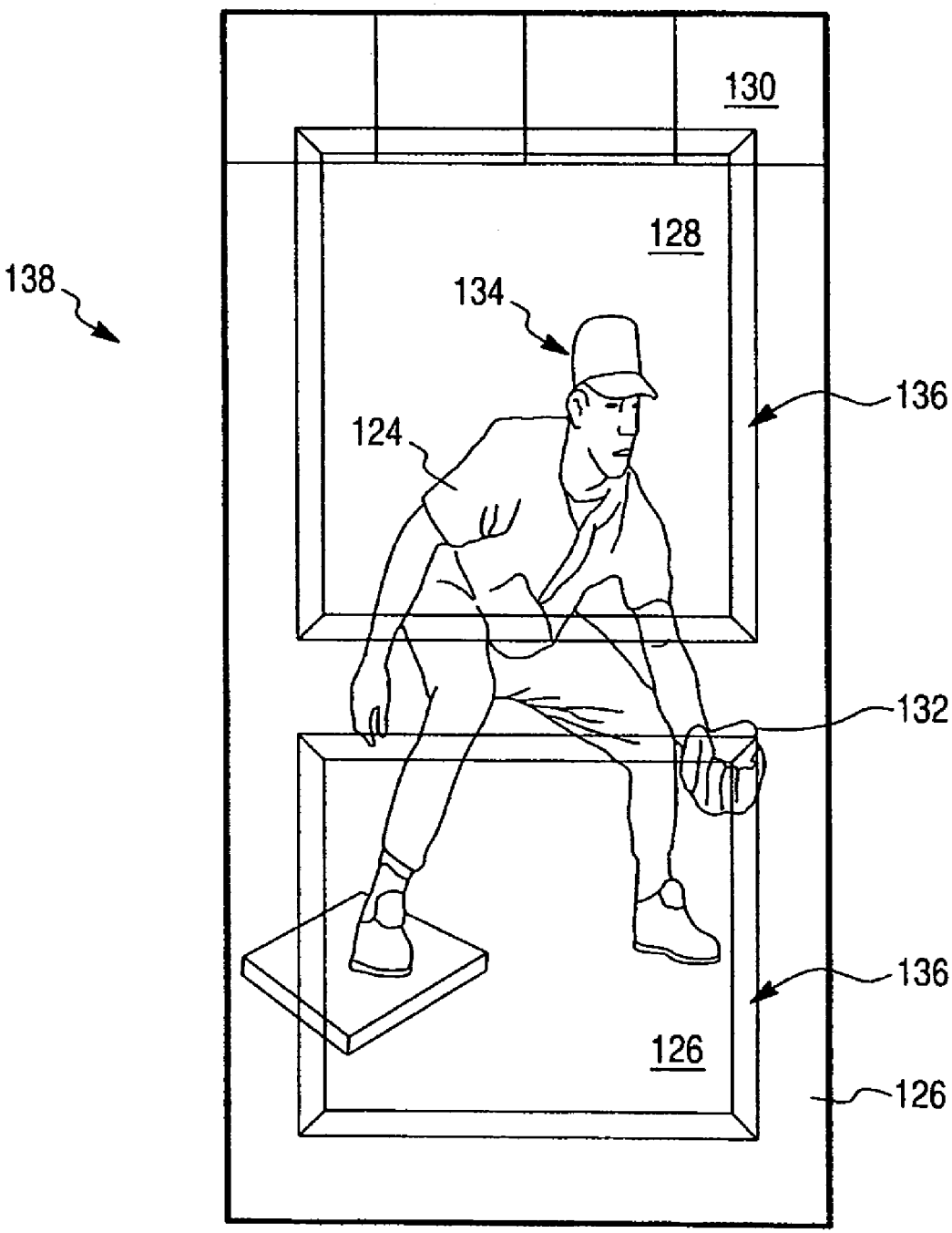
FIG. 21 is a front elevational view of a molded door having the graphic image of FIG. 20 printed thereon.

As best shown in FIG. 20, any image may be printed on an object, including a multi-color photographic quality image. For example, a door 120 may be printed to include a graphic image. The image comprises a baseball player 122 wearing an off-white uniform 124 standing on a light brown dirt infield 126 adjacent a green outfield 128 bounded by a dark green wall 130. Player 122 has a brown glove 132 and a red cap 134. In this example, the dominant color of the graphic image is light brown. This color covers approximately half of the door 120, and is compatible with the greens of the outfield 128 and wall 130. Therefore, a white primary ground coat is preferably applied to door 120 before the image is printed thereon to bring out the colors of the image. The image is broken down or otherwise organized into two separate components, a first image component to be applied on the exterior surface of the door in a first print step, and a second image component to be applied to a first topcoat so as to provide a three dimensional sensation. For example, portions of the player 122 in the foreground, e.g., the glove 132, red cap 134 and base, may be printed in the second printing step as part of the second image component. The features of the first image component are thereby provided with an exaggerated depth appearance. The image may overlap molded recessed areas 136 of a door 138 without reducing image quality, as best shown in FIG. 21.

Figure 22:
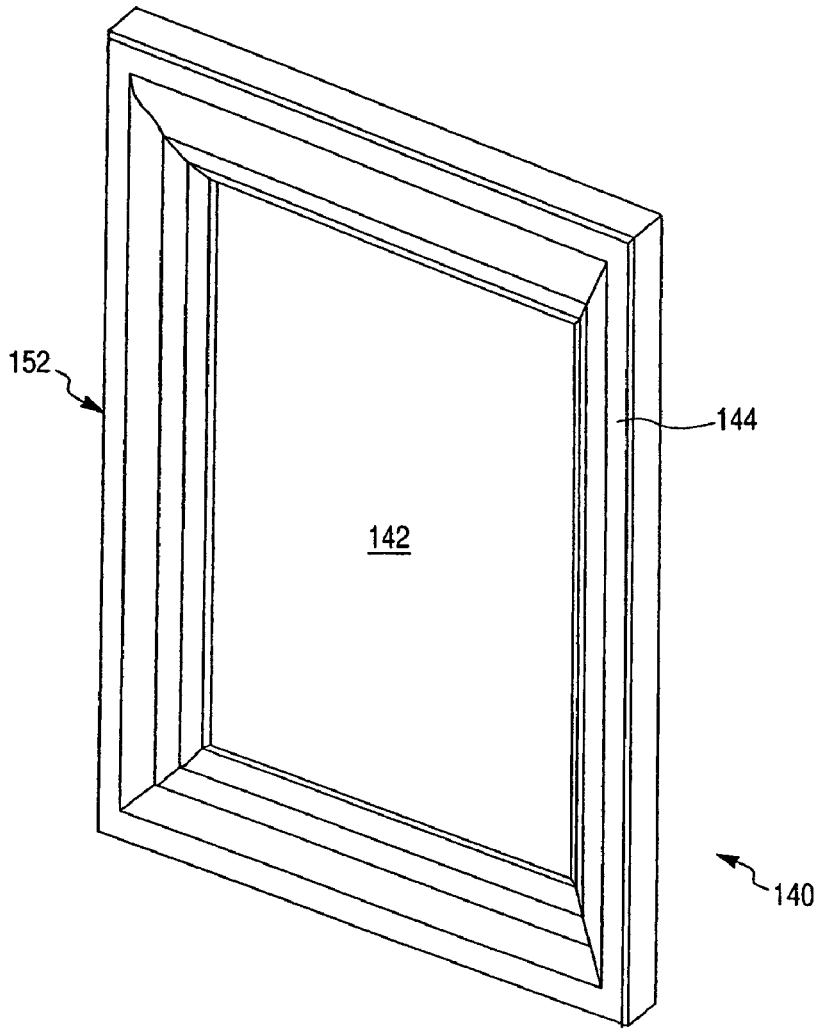
FIG. 22 is a perspective view of a molded casing to be printed according to an embodiment of the present invention.
Figure 23:
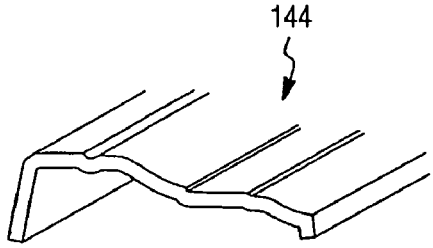
FIG. 23 is a fragmentary perspective view of an outer frame of the molded casing of FIG. 22.
Figure 24:
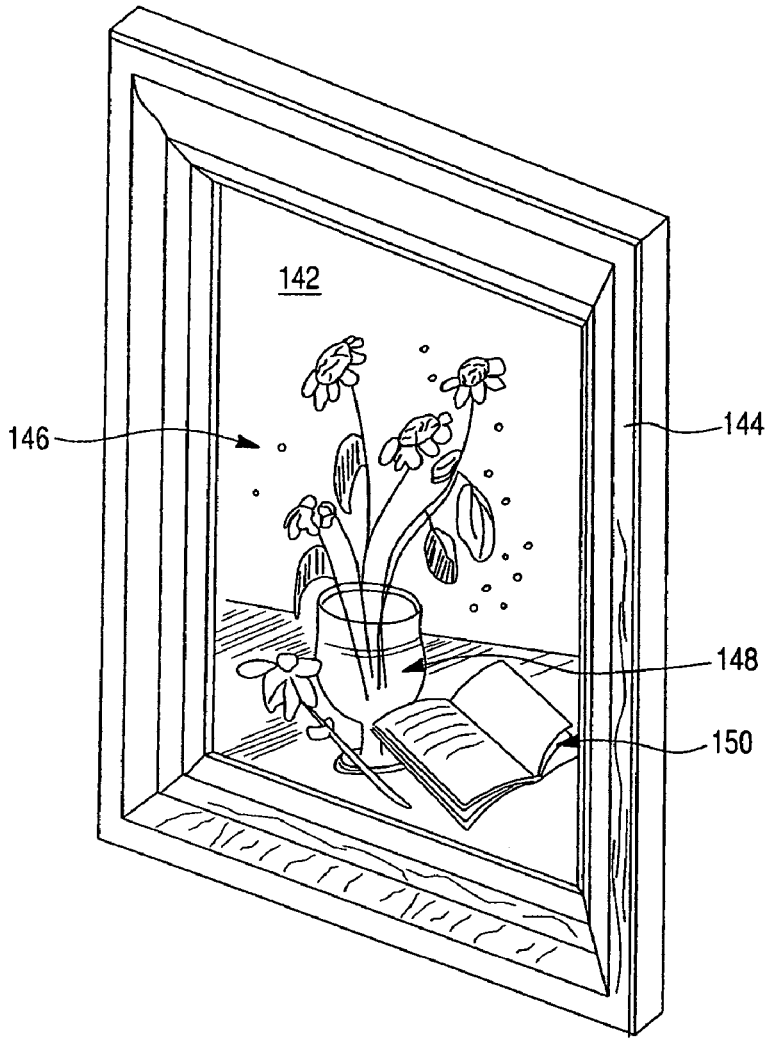
FIG. 24 is a perspective view of the molded casing of FIG. 22 after having been printed according to an embodiment the present invention.
Figure 25:
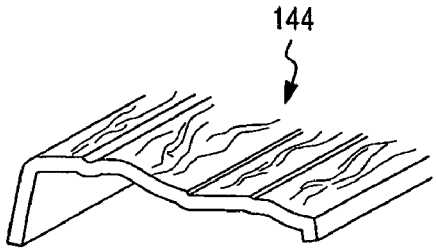
FIG. 25 is a fragmentary perspective view of the outer frame of FIG. 24 after having been printed according to an embodiment the present invention.

For some applications, it may be desirable to print onto contoured portions (such as channels 30) of a molded object in a manner that suggests a frame surrounding an image, as best shown in FIGS. 22-25. It should be understood that the object may be formed from various substrates, including steel, wood composite, post-formed MDF, molded fiberglass polymeric material, or pressed steel, or any combination thereof. As shown in FIGS. 22 and 23, a molded casing 140 includes a central planar portion 142 and a contoured outer frame 144. As shown in FIGS. 24 and 25, a wood grain pattern has been printed onto contoured outer frame 144 by ink jet printing. In addition, an image 146 of a flowerpot 148, flowers 149 and book 150 has been printed onto planar portion 142. The image 146 may be printed using ink jet printing techniques disclosed herein. Image 146 may include various colors, just as with the image of baseball player 122 in FIG. 21. Image 146 does not extend onto outer frame 144. Thus, a fully "framed" picture is simulated after one printing operation onto molded casing 140.

According to another embodiment, either one of the image 146 or the wood grain pattern of the frame 144 may be printed using an embodied method of the invention, whereas the other is printed without being separated into distinct image components and interposed by a first coating layer. For example, contoured outer frame 144 may also be printed to have a plain border, such as black or brown.

The appearance of ornate, carved wood frames or wood inlays may also be simulated. It will be appreciated that an acceptable effect might still be achieved even if outer frame 144 is not contoured but rather planar with planar portion 142. For example, a similar image may be obtained on a flush door or planar tabletop. However, the contour of outer frame 144 often advantageously allows for the production of a more realistic looking frame. The same or a different image can be printed on the opposite surface.

As best shown in FIGS. 26 and 27, wainscot 160 may also be printed with a wood grain pattern and/or image in a similar manner, wherein central planar portions 162 may be printed with an image, and outer molded portions 164 may be printed with a wood grain pattern. The printing procedure embodied herein may be applied to the central planar portions 162 alone, the outer molded portions 164 alone, or a combination of the central planar portions 162 and the outer molded portions 164. Wainscot 160 may also include an outer portion 166. Of course, the entire surface (162, 164 and 166) may also be printed with the wood grain pattern, if desired by the consumer.

Figure 28:
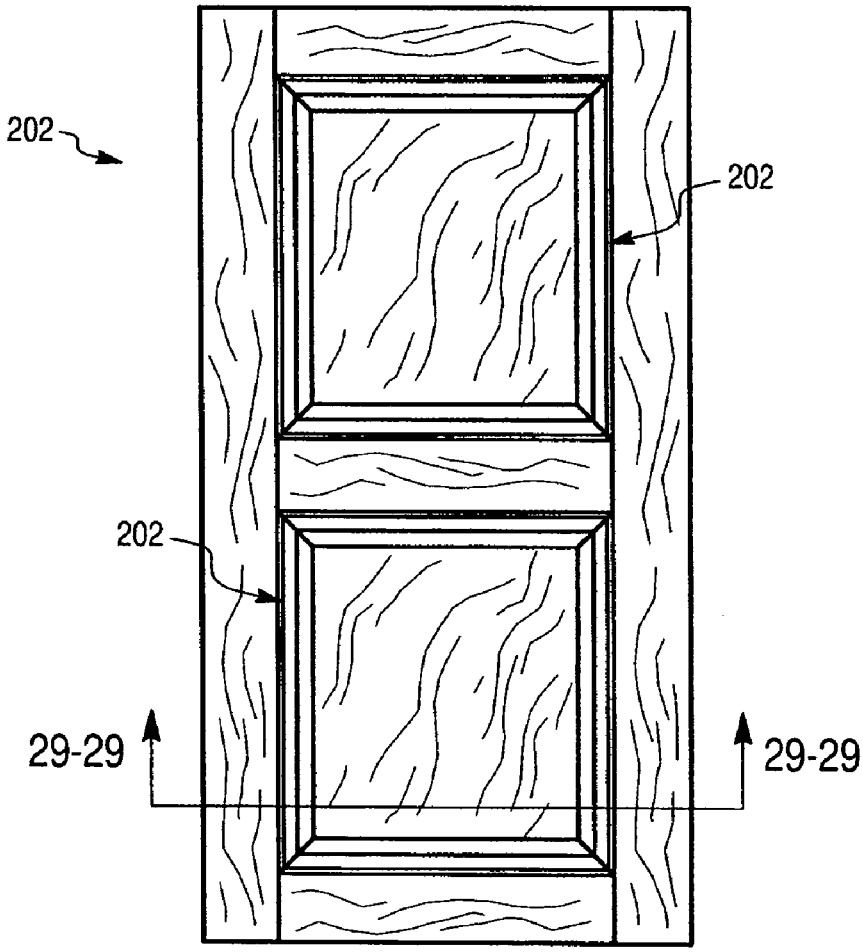
FIG. 28 is a front elevational view of a door facing having an ink jet printed sheet laminated thereon.
Figure 29:
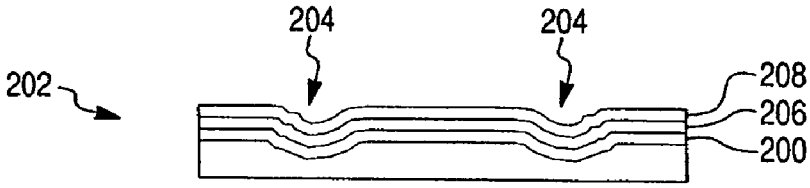
FIG. 29 is a sectional view taken along line 29-29 in FIG. 28 and viewed in the direction of the arrows.

In another aspect of the present invention, a synthetic printing sheet 200, such as made of Teslin™, is first molded onto a surface to be printed, such as door facing 202 as best shown in FIGS. 28 and 29. Preferably, printing sheet 200 has a color that is related to the dominant color (as explained above), or has a color that is the dominant color. In this way, application of ground coats may be obviated. Printing sheet 200 is laminated onto facing 202 using conventional techniques, such as with a membrane press or post molding press, either in-press or out of press.

Preferably, printing sheet 200 is comprised of a moldable, polyolefin material that stretches as it is formed onto facing 202. As such, sheet 200 does not wrinkle as it is being formed onto facing 202, even in contoured portions and molded corners, such as contoured portions 204 of facing 202. A suitable printing sheet is a Teslin™ sheet manufactured by PPG Architectural Finishes, Inc. of Pittsburgh, Pa. The Teslin™ sheet preferably has a thickness of about 7 millimeters.

Then, facing 202 is forwarded to a printing station (such as printing station 50) for ink jet printing the first desired pattern or image component 206 thereon. The surface of facing 202, covered by printing sheet 200, is particularly well suited for ink jet printing because printing sheet 200 has a uniform surface. Teslin™ material is designed as a printing surface. Facing 202 is ink jet printed as described above. Alternatively, printing sheet 200 may first be ink jet printed with the desired pattern or image component 206 (and optional component 210) prior to laminating sheet 200 onto facing 202.

Printing sheet 200 is ink jet printed as disclosed above, i.e., is subjected to a first printing step for forming a first desired pattern or image component 206, a first protective coating application step for forming a first topcoat 208, and a second printing step for forming a second desired pattern or image component 210. Then, sheet 200 is laminated onto facing 202 during an in-press lamination process. The printed pattern stretches onto any molded or contoured portions 204 of facing 202 as sheet 200 stretches onto facing 202. In this way, the image quality is maintained, achieving a high quality print. Pre-printing of sheet 200, prior to lamination onto facing 202, is suitable for non-directional images and patterns. However, ink jet printing sheet 200 after it has been laminated onto facing 202 is preferred for more detailed images and multi-directional patterns. Further, sheet 200 is formed onto facing 202 and facing 202 is molded into its final contoured configuration in one molding step. Thus, printing and forming are accomplished in a cost efficient manner.

After printing sheet 200 is printed and formed onto facing 202 (either before or after ink jet printing sheet 200), a second topcoat 212 may be applied to facing 202 as described above. Alternatively, the second topcoat 212 may be applied prior to joining the printing sheet 200 to the facing 202.

It is to be understood that the image may be separated into two constituent elements or components, with two topcoats applied to the object. For example, a process may comprise printing first and second image components of an overall image. In this example, the process may comprise the steps of applying a first top coat between the first and second image components, and a top second coat after the second image component. Thus, the process may comprise printing the first image component on the object exterior surface, applying a first coat to the exterior surface to cover the first image component, printing the second image component on the first coat, then applying a second coat over the second image components. It thus becomes apparent that many combinations and variations may be practiced and produced under aspects of the invention.

The present invention has been described herein in terms of several preferred embodiments. However, it should be understood that numerous modifications and variations to these embodiments would be apparent to those skilled in the art upon a reading of the foregoing description. For example, nearly any image that can be captured or stored digitally, or generated on a digital image generating system, can be applied to an object to be printed, such as a door skin or similar wood composite substrate. In addition, the disclosed invention may be applied to various objects, such as moldings, cabinet doors, wainscot panels, and the like. Therefore, it is intended that any such modifications and variations comprise a part of this invention, provided they come within the scope of the following claims and their equivalents.

What is claimed is:

1. A method of printing an image on an object, comprising the steps of;

providing an object having an exterior surface, the object being selected from the group consisting of exterior passage doors, interior passage doors, furniture and cabinet doors, closet doors, bifold doors, molded wall paneling, wainscot, and door skins;

cleaning the exterior surface;

printing a first image component on the cleaned exterior surface;

applying a first transparent coat on the exterior surface so as to cover the first image component;

printing a second image component on the first transparent coat; and determining whether application of a second transparent coat is desirable and applying a second transparent coat over the first transparent coat and second image component so as to cover the first and second image components if it is determined that application of the second transparent coat is desirable.

2. The method of claim 1, including the step of cleaning the exterior surface with one of water, acetone and/or ethanol.

3. The method of claim 1, further comprising the step of applying at least one ground coat on the exterior surface prior to said printing a first image step.

4. The method of claim 3, wherein the ground coat has a surface tension in the range of between about 38 to about 50 surface dynes.

5. The method of claim 3, including the step of curing the ground coat prior to said printing a first image step.

6. The method of claim 1, including the steps of providing an ink jet printer and using UV-curable ink for printing the first image component.

7. The method of claim 6, including the step of curing the first image component prior to said step of applying a first transparent coat.

8. The method of claim 7, including the step of printing and drying the second image component prior to said optional step of applying a second transparent coat.

9. The method of claim 1, including the step of aligning the second image component with the first printed image component so that registration of the first and second image components is offset by less than 0.5 inch.

10. The method of claim 1, further comprising the step of applying the second transparent coat over the first transparent coat and second image component so as to cover the first and second image components.

11. The method of claim 1, wherein the step of providing the object comprises providing the door skin having an exterior surface, a major planar portion, simulated panels, and channels surrounding the simulated panels.

12. A method of printing an image on an object, comprising the steps of:

providing an object having an exterior surface, the object being selected from the group consisting of exterior passage doors, interior passage doors, furniture and cabinet doors, closet doors, bifold doors, molded wall paneling, wainscot, and door skins;

printing a first image on a majority of the exterior surface;

applying a first transparent coat on the exterior surface so as to cover the first image in its substantial entirety;

printing a second image on the first transparent coat; and applying a second transparent coat over the first transparent coat and second image so as to cover the first and second images.

13. The method of claim 12, wherein the printing of the first and second images comprises printing at least one natural wood simulating pattern.

14. A method of printing an image on an object, comprising the steps of:

providing an object having an exterior surface, the object being selected from the group consisting of exterior passage doors, interior passage doors, furniture and cabinet doors, closet doors, bifold doors, molded wall paneling, wainscot, and door skins;

providing an ink jet printer and using UV-curable ink;

printing a first image component on the exterior surface using the ink jet printer and UV-curable ink;

applying a first transparent coat on the exterior surface so as to cover the first image component;

printing a second image component on the first transparent coat; and determining whether application of a second transparent coat is desirable and applying a second transparent coat over the first transparent coat and second image component so as to cover the first and second image components if it is determined that application of the second transparent coat is desirable.

15. The method of claim 14, further comprising the step of applying at least one ground coat on the exterior surface prior to said printing a first image step.

16. The method of claim 15, wherein the ground coat has a surface tension in the range of between about 38 to about 50 surface dynes.

17. A method of printing an image on an object, comprising the steps of:

providing a door skin having an exterior surface, a major planar portion, simulated panels, and channels surrounding the simulated panels;

printing a first image component on the exterior surface;

applying a first transparent coat on the exterior surface so as to cover the first image component;

printing a second image component on the first transparent coat; and determining whether application of a second transparent coat is desirable and applying a second transparent coat over the first transparent coat and second image component so as to cover the first and second image components if it is determined that application of the second transparent coat is desirable.

18. The method of claim 17, wherein the door skin is formed from a material selected from the group of metal, metal alloy, medium density fiberboard, and high density fiberboard.

19. The method of claim 17, wherein the door skin possesses an overlay establishing the exterior surface.

20. The method of claim 17, including the further step of applying a first ground coat on the exterior surface prior to said printing a first image step.

21. The method of claim 20, including the further step of applying a second ground coat to the channels.

22. The method of claim 20, including the further step of curing the ground coat prior to said printing a first image step.

* * * * *

UNITED STATES PATENT AND TRADEMARK OFFICE

CERTIFICATE OF CORRECTION

PATENT NO. : 7,438,407 B2
APPLICATION NO. : 11/226470
DATED : October 21, 2008
INVENTOR(S) : Henry M. Coghlan et al.

It is certified that error appears in the above-identified patent and that said Letters Patent is hereby corrected as shown below:

In the Specification

Column 1, line 11, change "35 U.S.C. §120" to read --35 U.S.C. § 119(e).--

Signed and Sealed this
Twentieth Day of May, 2014

Michelle K. Lee

Michelle K. Lee
*Deputy Director of the United States Patent and Trademark Office*